US008358953B2

(12) United States Patent
Itabashi

(10) Patent No.: US 8,358,953 B2
(45) Date of Patent: Jan. 22, 2013

(54) IMAGE-FORMING DEVICE HAVING HOLDER UNIT FOR TONER BOX

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 108 days.

(21) Appl. No.: 13/075,102

(22) Filed: Mar. 29, 2011

(65) Prior Publication Data

US 2011/0280619 A1 Nov. 17, 2011

(30) Foreign Application Priority Data

May 17, 2010 (JP) ..... 2010-113665

(51) Int. Cl.
*G03G 15/00* (2006.01)
*G03G 15/08* (2006.01)

(52) U.S. Cl. ..... 399/110; 399/258; 399/411

(58) Field of Classification Search ..... 399/110–112, 399/114, 119, 120, 258, 262, 411
See application file for complete search history.

(56) References Cited

U.S. PATENT DOCUMENTS

| | | | | |
|---|---|---|---|---|
| 7,561,836 | B2 | 7/2009 | Takagi | |
| 7,587,155 | B2 | 9/2009 | Suzuki et al. | |
| 7,639,968 | B2 | 12/2009 | Takagi | |
| 7,647,005 | B2 | 1/2010 | Takagi | |
| 2006/0067734 | A1 | 3/2006 | Igarashi | |
| 2006/0280526 | A1 * | 12/2006 | Shimomura | 399/258 |
| 2007/0223963 | A1 | 9/2007 | Suzuki et al. | |
| 2007/0223964 | A1 | 9/2007 | Takagi | |
| 2007/0223965 | A1 | 9/2007 | Takagi | |
| 2007/0223971 | A1 | 9/2007 | Takagi | |
| 2009/0297209 | A1 | 12/2009 | Nakajima et al. | |
| 2010/0111563 | A1 * | 5/2010 | Sato | 399/119 |

FOREIGN PATENT DOCUMENTS

| | | | |
|---|---|---|---|
| CN | 101059682 | A | 10/2007 |
| JP | H09-269639 | A | 10/1997 |
| JP | H09-269716 | A | 10/1997 |

(Continued)

OTHER PUBLICATIONS

Japan Patent Office, Decision to Grant for Japanese Patent Application No. 2010-113665 (counterpart to above-captioned patent application), mailed Feb. 7, 2012.

State Intellectual Property Office of the People's Republic of China, The First Office Action for Chinese Patent Application No. 201110141306.5 (counterpart Chinese patent application), mailed Oct. 9, 2012.

*Primary Examiner* — David Gray
*Assistant Examiner* — Joseph S Wong
(74) *Attorney, Agent, or Firm* — Baker Botts L.L.P.

(57) ABSTRACT

An image forming device includes: a main casing; a holder unit; a plurality of image bearing members; a plurality of developing units; a plurality of toner boxes; a first acting portion; a second acting portion; and an abutment member. The holder unit is configured to be movable in a moving direction between an accommodated position and a pull-out position. The plurality of image bearing members are held by the holder unit and are juxtaposedly arrayed in the moving direction with intervals between neighboring image bearing members. The plurality of developing units are held by the holder unit in one to one correspondence with the plurality of image bearing members. The plurality of toner boxes are detachably attachable to the holder unit in one to one correspondence with the plurality of developing units. Each toner box is detachably attachable to the holder unit at the pull-out position.

13 Claims, 18 Drawing Sheets

FOREIGN PATENT DOCUMENTS

| | | | |
|---|---|---|---|
| JP | 2006098772 | A | 4/2006 |
| JP | 2008-191578 | A | 8/2008 |
| JP | 2009-086289 | A | 4/2009 |
| JP | 2009-288473 | A | 12/2009 |

* cited by examiner

IMAGE-FORMING DEVICE HAVING HOLDER UNIT FOR TONER BOX

CROSS REFERENCE TO RELATED APPLICATION

This application claims priority from Japanese Patent Application No. 2010-113665 filed May 17, 2010. The entire content of the priority application is incorporated herein by reference.

TECHNICAL FIELD

The present invention relates to an image forming device such as a laser printer.

BACKGROUND

According to a conventional tandem type color printer, four photosensitive drums for the colors of yellow magenta, cyan and black can be integrally attached to or detached from a main casing.

In such type of color printer, a frame can be pulled out in a horizontal direction from the main casing, and four photosensitive drums are held in the frame and arrayed in a pull-out direction of the frame. Further, developing cartridges provided with developing rollers and corresponding to these photosensitive drums are detachably mounted on the frame from the above. If toner in a developing cartridge gets empty, the developing cartridge is taken out of the frame, and a new developing cartridge is mounted on the frame.

SUMMARY

Recently, a low cost and environmentally preferable printer is required. To this effect, exchange in toner box only is preferable rather than exchange in developer cartridge when the toner is used up. In the exchange in toner box only, only the toner box is exchanged with a new toner box while a developing roller remains in the frame.

It is an object of the invention to provide an improved image-forming device, in which a holder unit is movably provided and a toner box is detachably mounted in the holder unit.

In order to attain the above and other objects, the invention provides an image forming device including: a main casing; a holder unit; a plurality of image bearing members; a plurality of developing units; a plurality of toner boxes; a first acting portion; a second acting portion; and an abutment member. The main casing defines an accommodation space. The holder unit is configured to be movable in a moving direction between an accommodated position in which the holder unit is accommodated in the accommodation space and a pull-out position in which at least part of the holder unit is outside the accommodation space. The plurality of image bearing members are held by the holder unit and are juxtaposedly arrayed in the moving direction with intervals between neighboring image bearing members. The plurality of developing units are held by the holder unit in one to one correspondence with the plurality of image bearing members. The plurality of toner boxes are detachably attachable to the holder unit in one to one correspondence with the plurality of developing units. Each toner box is detachably attachable to the holder unit at the pull-out position. Each toner box includes: a toner container accommodating therein toner and formed with an opening through which toner in the toner container is to be supplied to the corresponding developing unit; and a shutter movable between an open position for opening the opening and a closed position for closing the opening. The first acting portion is provided at the holder unit and is configured to be movable between a first position providing the open position of the shutter and a second position providing the closed position of the shutter. The second acting portion is provided at the holder unit and is configured to be movable between a third position providing the open position of the shutter and a fourth position providing the closed position of the shutter. The abutment member is provided in the main casing and configured to allow the first acting portion to abut against the abutment member when the holder unit is on its way to the accommodated position from the pull-out position while the first acting portion is at the second position, to thereby move the first acting portion to the first position, and to allow the second acting portion to abut against the abutment member when the holder unit is on its way to the pull-out position from the accommodated position while the second acting portion is at the third position, to thereby move the second acting portion to the fourth position.

DETAILED DESCRIPTION

Next, an embodiment of the present invention will be described while referring to the accompanying drawings.

1. Structure of a Color Printer

Figure 1:
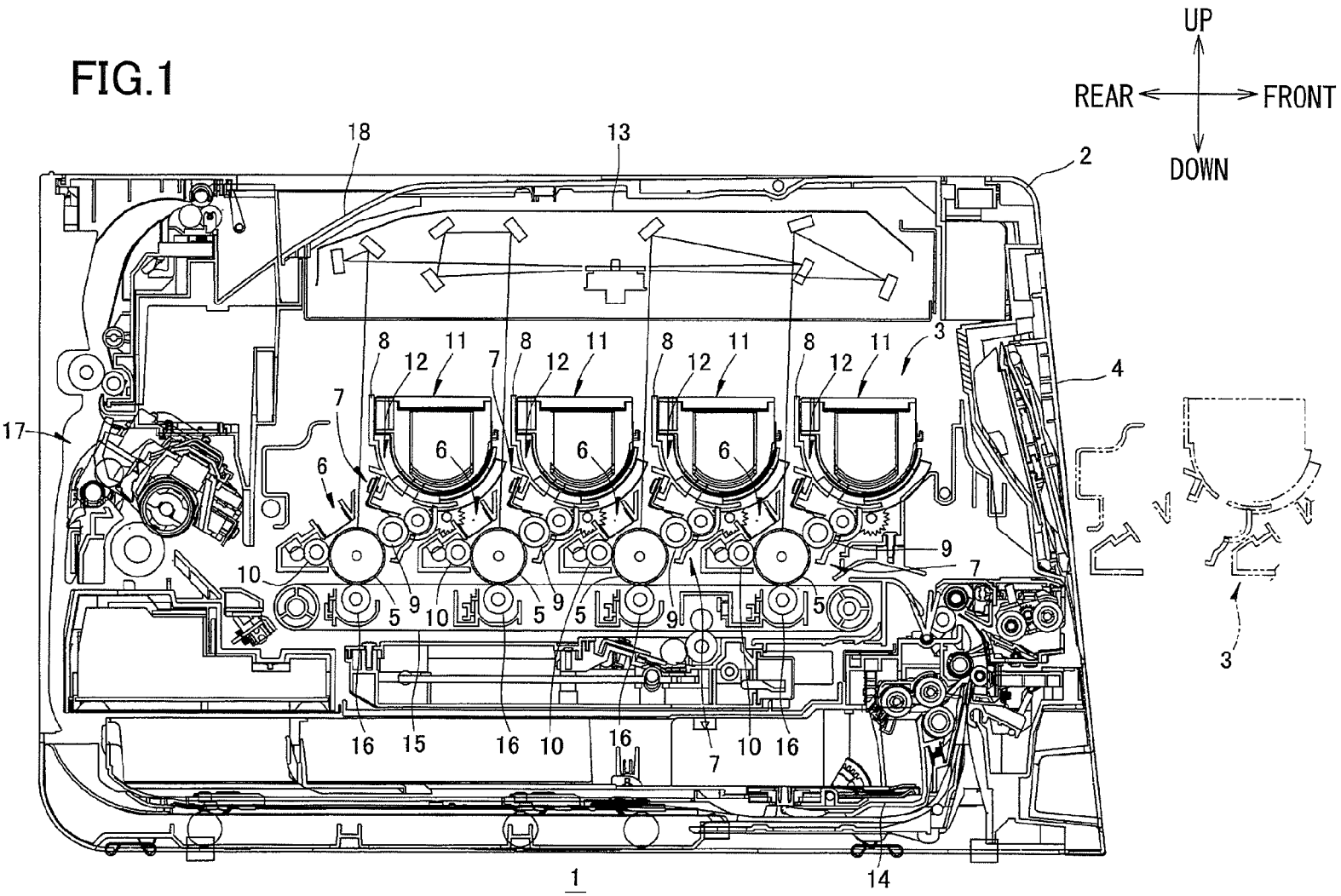
FIG. 1 is a cross-sectional view of a color printer according to an embodiment of the present invention.
Figure 2:
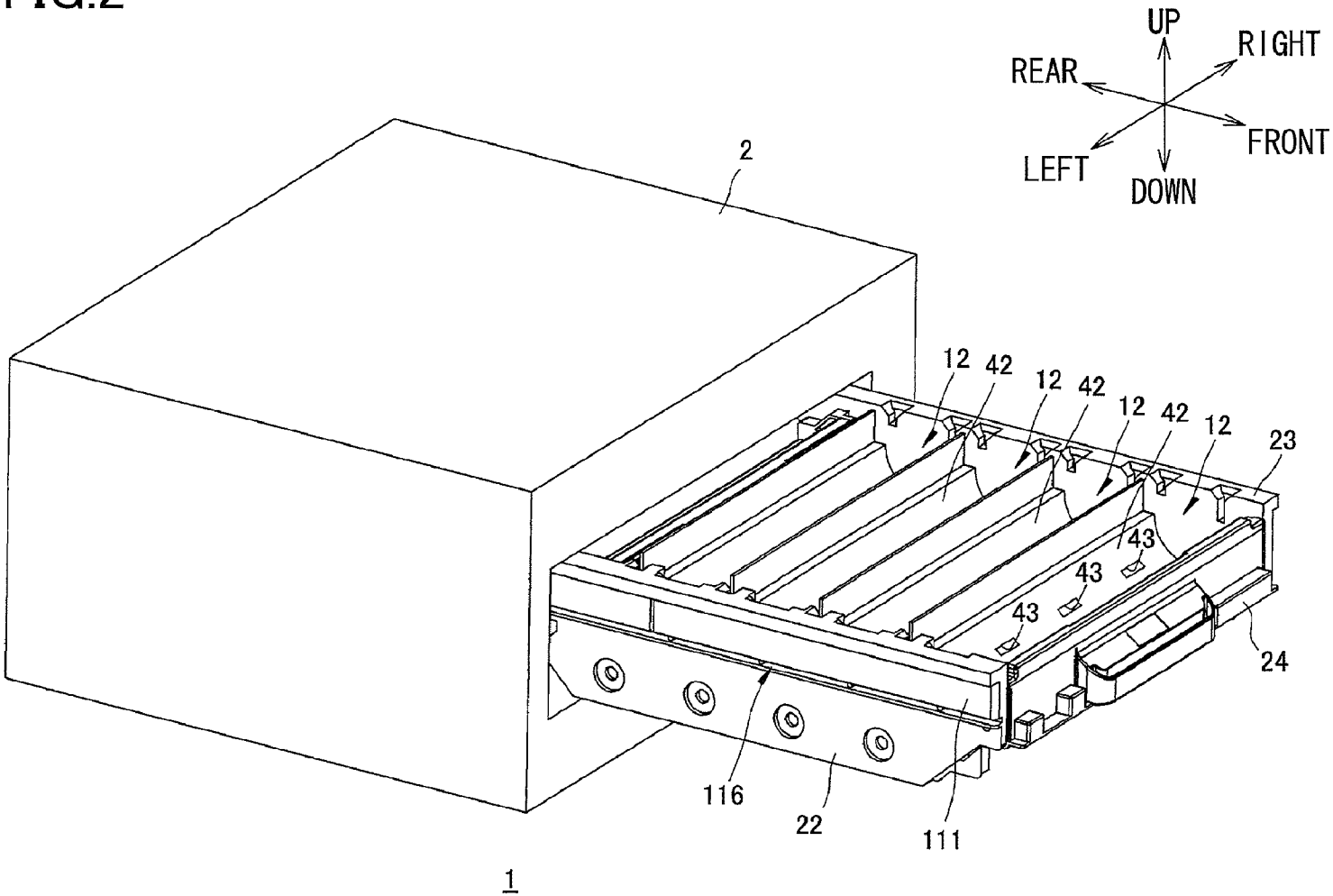
FIG. 2 is a perspective view of the color printer in FIG. 1 showing a drawer unit that has been pulled outward from a main frame of the printer.

As shown in FIG. 1, the image-forming device according to the embodiment is a tandem-type color printer 1. As shown in FIGS. 1 and 2, the color printer 1 includes a main casing 2. A drawer unit 3 is mounted inside the main casing 2. A front cover 4 is provided on the front surface of the main casing 2 and is capable of being opened and closed thereon. When the front cover 4 is open, the drawer unit 3 can be moved horizontally between an accommodated position inside the main casing 2, as indicated by solid lines in FIG. 1, and a pull-out position outside the main casing 2, as depicted virtually by dotted lines in FIG. 1 and shown in FIG. 2. It is noted that when the drawer unit 3 is in the pull-out position, the drawer unit 3 protrudes outside the main casing 2 through an opening of the main casing 2 opened by the front cover 4, but is still partly mounted in the main casing 2. That is, when the drawer unit 3 is in the pull-out position, the drawer unit 3 is not detached from the main casing 2, but is still supported by the main casing 2. For example, a guide unit (not shown) is provided in the main casing 2 to guide the drawer unit 3 between the accommodated position and the pull-out position. The drawer unit 3 is slidably movable on the guide unit between the accommodated position and the pull-out position. So, even when the drawer unit 3 is in the pull-out position, the drawer unit 3 is still partly on the guide unit, and is therefore not detached from the main casing 2. Thus, also in the pull-out position, the drawer unit 3 is still mounted in the main casing 2, while partly protruding outside of the main casing 2.

In the following description, the side of the color printer 1 on which the front cover 4 is provided (right side in FIG. 1) will be referred to as the front side of the color printer 1. The top, bottom, left, and right sides of the color printer 1 in the following description will be based on the reference point of a user viewing the color printer 1 from the front side. Directions related to the drawer unit 3 and toner boxes 11, described later, that are mounted in the drawer unit 3 will be referenced based on their positions when mounted in the main casing 2, unless otherwise specified. Note that the front cover 4 has been omitted from FIG. 1

As shown in FIG. 1, four photosensitive drums 5 (image-bearing members) are rotatably retained in the drawer unit 3. The photosensitive drums 5 are capable of rotating about axes extending in the left-to-right direction. The four photosensitive drums 5 are respectively provided for the colors black, yellow, magenta, and cyan. The photosensitive drums 5 are arranged parallel to each other at regular intervals in the front-to-rear direction in the order black, yellow, magenta, and cyan.

Four chargers 6 are also retained in the drawer unit 3. The chargers 6 have a one-on-one correspondence to the four photosensitive drums 5 and are disposed at positions diagonally upward and rearward from the corresponding photosensitive drums 5. Each charger 6 is a Scorotron charger that includes a discharge wire and grid, for example.

Four developing units 7 are also retained in the drawer unit 3. The four developing units 7 also have a one-on-one correspondence to the four photosensitive drums 5 and are disposed diagonally above and forward of the corresponding photosensitive drums 5. Each developing unit 7 includes a developing unit frame 8, and a developing roller 9 accommodated in the developing unit frame 8. The developing roller 9 is disposed in contact with the photosensitive drum 5 and is capable of rotating about an axis extending in the left-to-right direction.

Four cleaners 10 are also retained in the drawer unit 3. The cleaners 10 are provided with a one-on-one correspondence to the four photosensitive drums 5 and are positioned rearward of the corresponding photosensitive drums 5. The cleaners 10 function to move paper dust and the like deposited on the surfaces of the photosensitive drums 5.

A space 12 is provided in the drawer unit 3 above each developing unit 7. A toner box 11 that accommodates toner is mounted in the space 12 formed above each developing unit 7. Sufficient room above the drawer unit 3 for mounting the toner boxes 11 in the spaces 12 is acquired by pulling the drawer unit 3 outward to the pull-out position. The toner boxes 11 supply toner to the corresponding developing units 7.

An exposure device 13 is provided in the main casing 2 above the drawer unit 3. The exposure device 13 irradiates four laser beams corresponding to the four colors used by the color printer 1.

As each photosensitive drum 5 rotates, the corresponding charger 6 applies a uniform charge to the surface of the photosensitive drum 5 through corona discharge. Subsequently, the exposure device 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of a photosensitive drum 5 rotates to a position opposite the corresponding developing roller 9, the developing roller 9 supplies toner to the latent image, developing the image into a toner image. That is, the developing roller 9 executes a developing operation.

Here, four LED arrays may be provided for the four photosensitive drums 5 in place of the exposure device 13.

A paper cassette 14 accommodating sheets of a paper P is disposed in a bottom section of the main casing 2. The paper P accommodated in the paper cassette 14 is conveyed onto a conveying belt 15 by various rollers. The conveying belt 15 confronts the four photosensitive drums 5 from below. Four transfer rollers 16 are disposed inside the conveying belt 15 at positions confronting each of the photosensitive drums 5 through the upper portion of the conveying belt 15. When a sheet of paper P is conveyed onto the conveying belt 15, the conveying belt 15 carries the sheet sequentially through positions between the conveying belt 15 and each of the photosensitive drums 5. As the sheet passes beneath each photosensitive drum 5, the toner image carried on the surface of the photosensitive drum 5 is transferred onto the paper P.

A fixing unit 17 is provided on the downstream end of the conveying belt 15 with respect to the direction that the paper P is conveyed. After toner images are transferred onto a sheet of paper P, the sheet is conveyed to the fixing unit 17, where the toner images are fixed to the sheet by heat and pressure. After the toner images are fixed in the fixing unit 17, various rollers discharge the sheet onto a discharge tray 18 formed on the top surface of the main casing 2.

2. Drawer Unit (1) Drawer Frame

Figure 3:
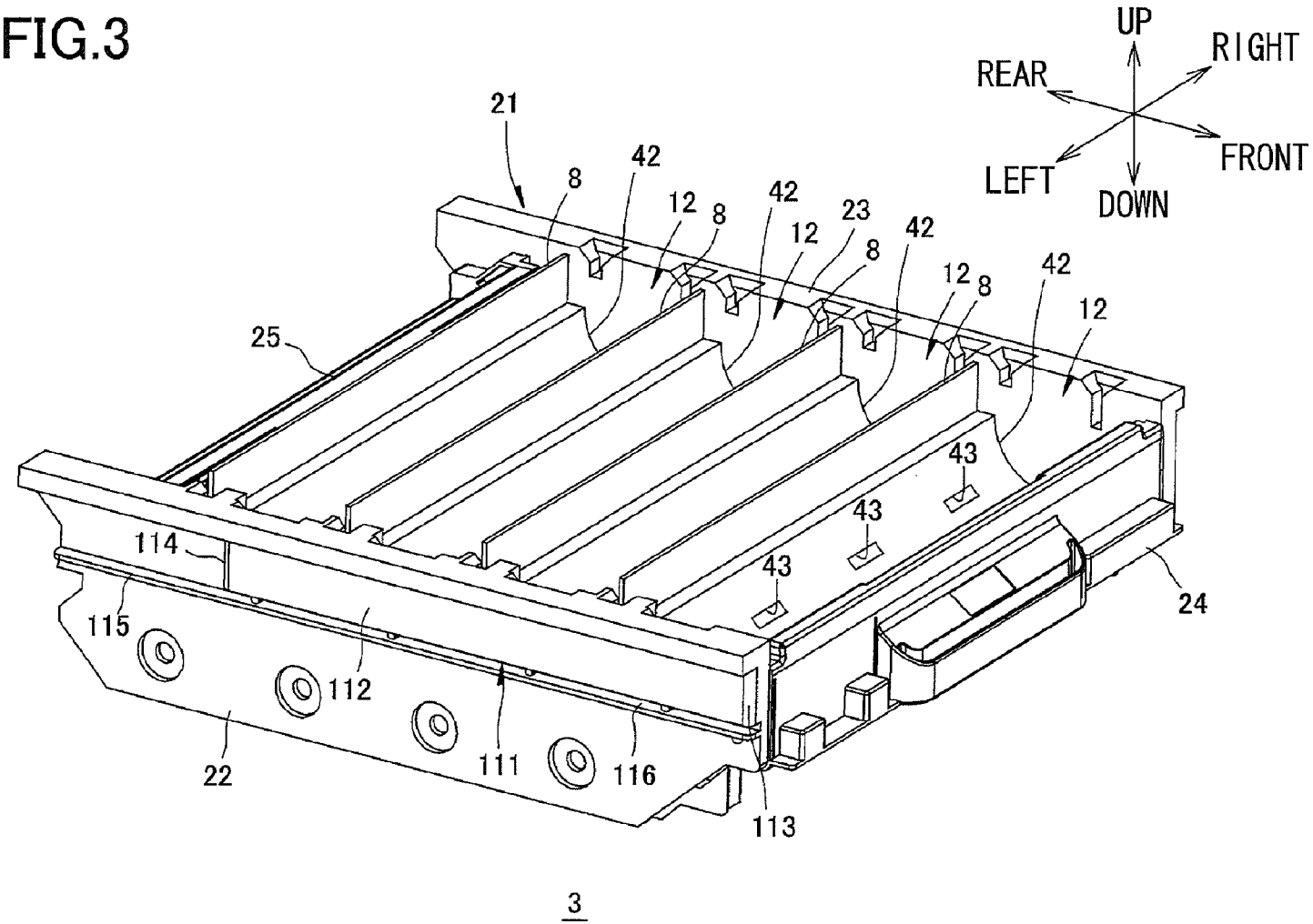
FIG. 3 is a perspective view of the drawer unit in FIG. 1 when toner boxes have all been removed.

As shown in FIG. 3, the drawer unit 3 has a drawer frame 21 (holder unit). The drawer frame 21 is configured of a pair of side plates 22 and 23 arranged parallel to each other and separated in the left-to-right direction, a front beam 24 bridging the front ends of the side plates 22 and 23, and a rear beam 25 bridging the rear ends of the side plates 22 and 23. The overall structure of the drawer frame 21 is square-shaped in a plan view.

The respective groups of four photosensitive drums 5, chargers 6, developing units 7, and cleaners 10 (see FIG. 1) are all held together between the side plates 22 and 23 on the left and right sides thereof. The spaces 12 in which the toner boxes 11 are mounted are formed between the side plates 22 and 23 above the corresponding developing units 7. In other words, the side plates 22 and 23 hold the photosensitive drums 5, chargers 6, developing units 7, and cleaners 10. Further, the side plates 22 and 23 oppose each other in the left-to-right direction, with gaps formed therebetween to allocate the spaces 12 in which the toner boxes 11 are mounted.

(2) Operation Member

Figure 4A:
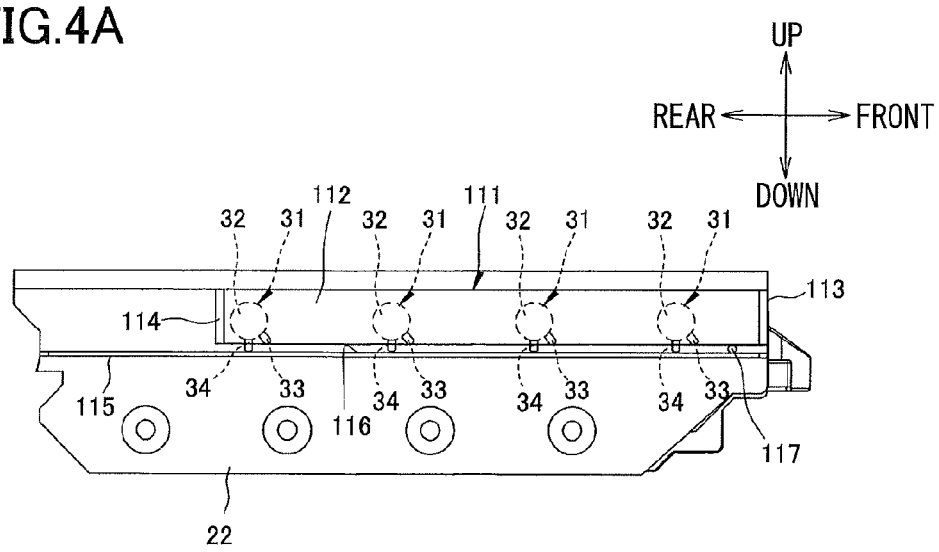
FIG. 4A is a left side view of the drawer unit in FIG. 1 when first acting portions of an operation member are in a first position, second acting portions of the operation member are in a third position, and shutters are in an open position.
Figure 4B:
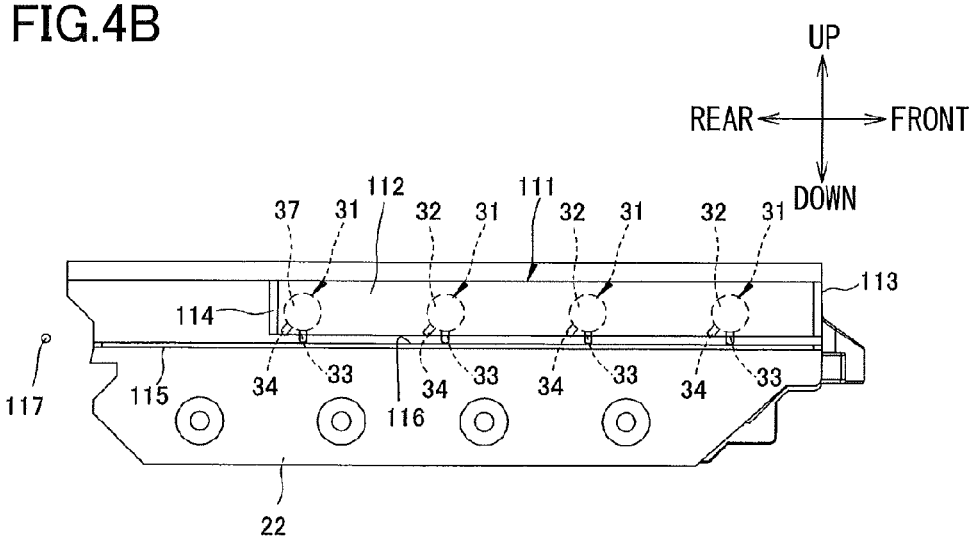
FIG. 4B is a left side view of the drawer unit when the first acting portions of the operation member are in a second position, the second acting portions of the operation member are in a fourth position, and the shutters are in the closed position.
Figure 5:
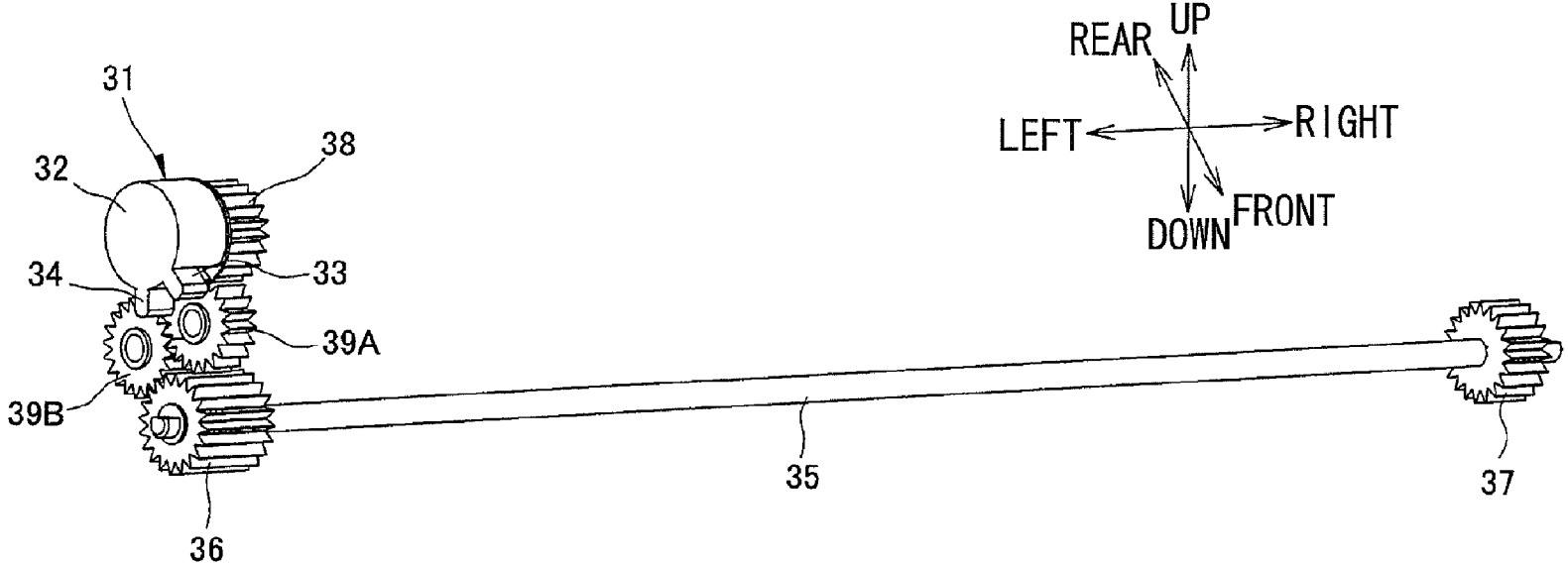
FIG. 5 is a perspective view of the acting portions of the operation member in FIGS. 4A and 4B.

As shown in FIGS. 4A and 4B, four operation members 31 are disposed in correspondence with the four spaces 12 on a left side (outer side) of the left side plate 22. As shown in FIG. 5, the operation member 31 integrally includes a main section 32 having a circular shape as viewed from a left side, and first and second acting portions 33 and 34 each having a quadrangular prism shape and protruding radially outwardly from an outer peripheral surface of the main section 32.

The main section 32 is fixed to a coupling shaft (not shown) rotatably extending through the left side plate 22, so that the main section 32 is rotatably supported to the left side plate 22.

The first and second acting portions 33, 34 are angularly offset from each other by 45 degrees in the circumferential direction of the main section 32.

Figure 6:
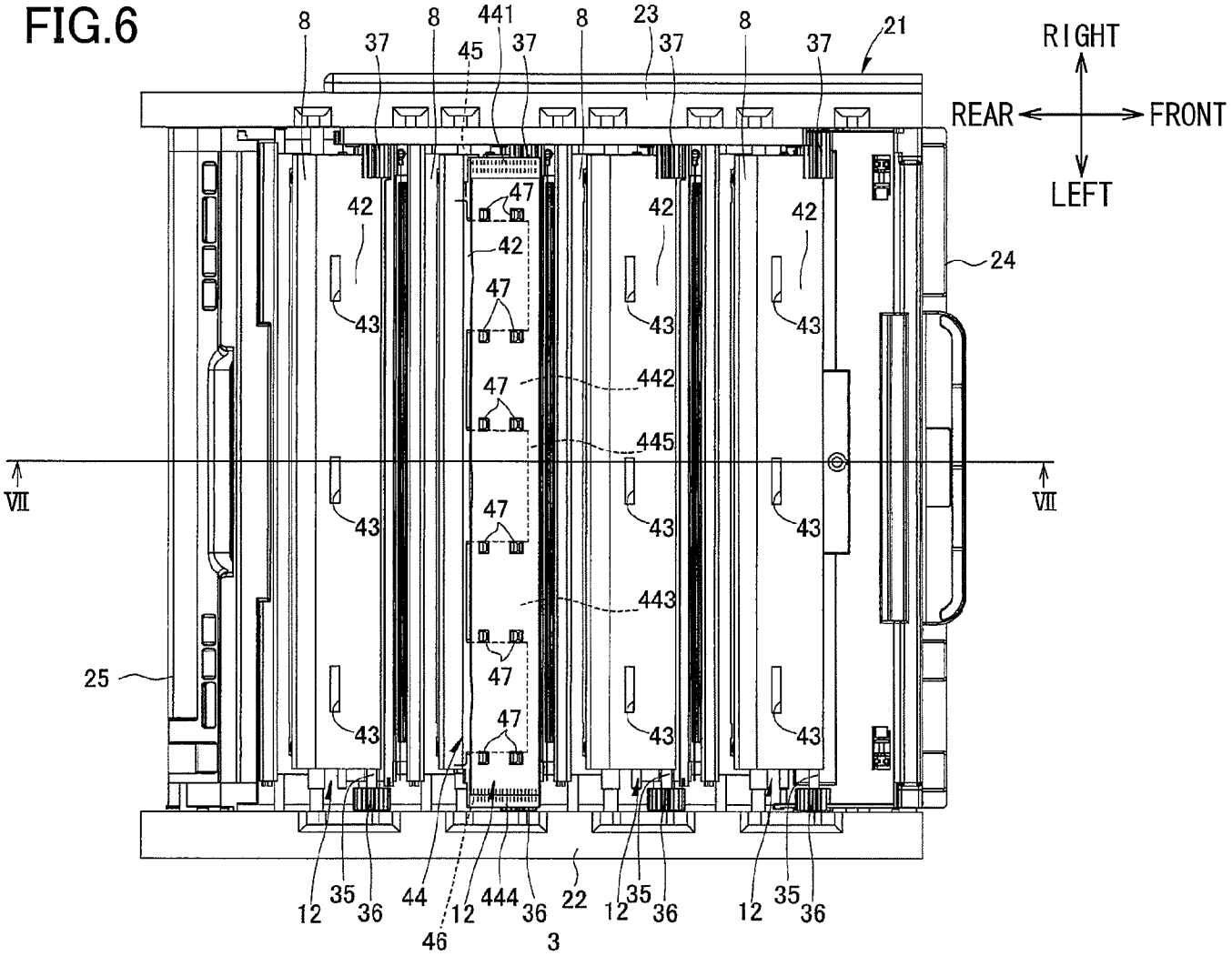
FIG. 6 is a plan view of the drawer unit in FIG. 3.

As shown in FIGS. 5 and 6, a shaft 35 extending in the lateral direction is positioned below each operation member 31. The shaft 35 spans between the left side plate 22 and right side plate 23 and is rotatably supported thereto. The shaft 35 has a left end portion fixedly provided with a left pinion gear 36 at a position laterally inward of (right side of) the left side plate 22. A minute gap is provided between a leftmost end of the left pinion gear 36 and the left side plate 22 so as not to disturb the rotation of the left pinion gear 36. The shaft 35 has a right end portion fixedly provided with a right pinion gear 37 at a position laterally inward of (left side of) the right side plate 23. The right pinion gear 37 has an axial length smaller than that of the left pinion gear 36. A minute gap is provided between a rightmost end of the right pinion gear 37 and the right side plate 23 so as not to disturb the rotation of the right pinion gear 37.

A coupling gear 38 is positioned opposite to the main section 32 with respect to the left side plate 22. The coupling gear 38 is fixed to a right end portion of the coupling shaft (not shown) rotatably extending through the left side plate 22. Thus, the coupling gear 38 is integrally rotatable along with the coupling shaft and the main section 32. Two intermediary gears 39A, 39B are provided for driving connection between the coupling gear 38 and the left pinion gear 36.

(3) Cover

As shown in FIG. 3, a cover 111 functioning as a shield member is provided at the left side of the left side plate 22 for covering four operation members 31. The cover 111 integrally includes a side plate 112 extending in the frontward/rearward direction, a front plate portion 113 protruding from a front end portion of the side plate 112 toward the left side plate 22 and contacting the left side surface of the left side plate 22, and a rear plate portion 114 protruding from a rear end portion of the side plate 112 toward the left side plate 22 and contacting the left side surface of the left side plate 22. The left side plate 22 has an upper end portion provided with a flange portion bent leftward, so that an upper edge of the cover 111 is positioned immediately below an upper end portion (or a flange portion) of the left side plate 22 and in contact therewith. Thus, the four operation members 31 are confined in a space that is surrounded by the cover 111 and the left side plate 22 and that is open to the bottom.

A free end portion of each of the first and second acting portions 33, 34 of each operation member 31 protrudes downward from a lower edge of the cover 111 (predetermined reference plane) and is exposed to the outside of the drawer unit 3 when the first and second acting portion 33, 34 is oriented vertically downward. Further, as shown in FIG. 4A, the free end portion of the first acting portion 33 is positioned above the lower edge of the cover 111, when the first acting portion 33 is oriented frontward and diagonally downward. Further, as shown in FIG. 4B, the free end portion of the second acting portion 34 is positioned above the lower edge of the cover 111 when the second acting portion 34 is oriented rearward and diagonally downward.

(4) Thin Plate Portion

A thin plate portion 115 is provided on the left side plate 22 at a position immediately below and spaced away from the lower edge of the cover 111 and extends in the frontward/rearward direction along an entire length of the left side plate 22. Thus, a groove like gap 116 is defined between the cover 111 and the thin plate portion 115. A width of the groove like gap 116, i.e., a clearance between the cover 111 and the thin plate portion 115 is such a size that prevents the first acting portion 33 and second acting portion 34 from contacting the thin plate portion 115, and to allow an abutment member 117 provided in the main casing 2 to pass through the gap 116.

As shown in FIGS. 4A and 4B, the abutment member 117 is cylindrically shaped, and extends from a left inner surface toward a right side of the main casing 2. Further, the abutment member 117 is at a position capable of passing through the gap 116 when the drawer unit 3 is moved between the accommodated position and the pull-out position.

(5) Developing Unit Frame

As shown in FIGS. 2 and 6, the developing unit frames 8 are disposed at regular intervals in the front-to-rear direction and span between the side plates 22 and 23. The developing unit frames 8 define the spaces 12 provided for mounting the toner boxes 11.

Figure 7:
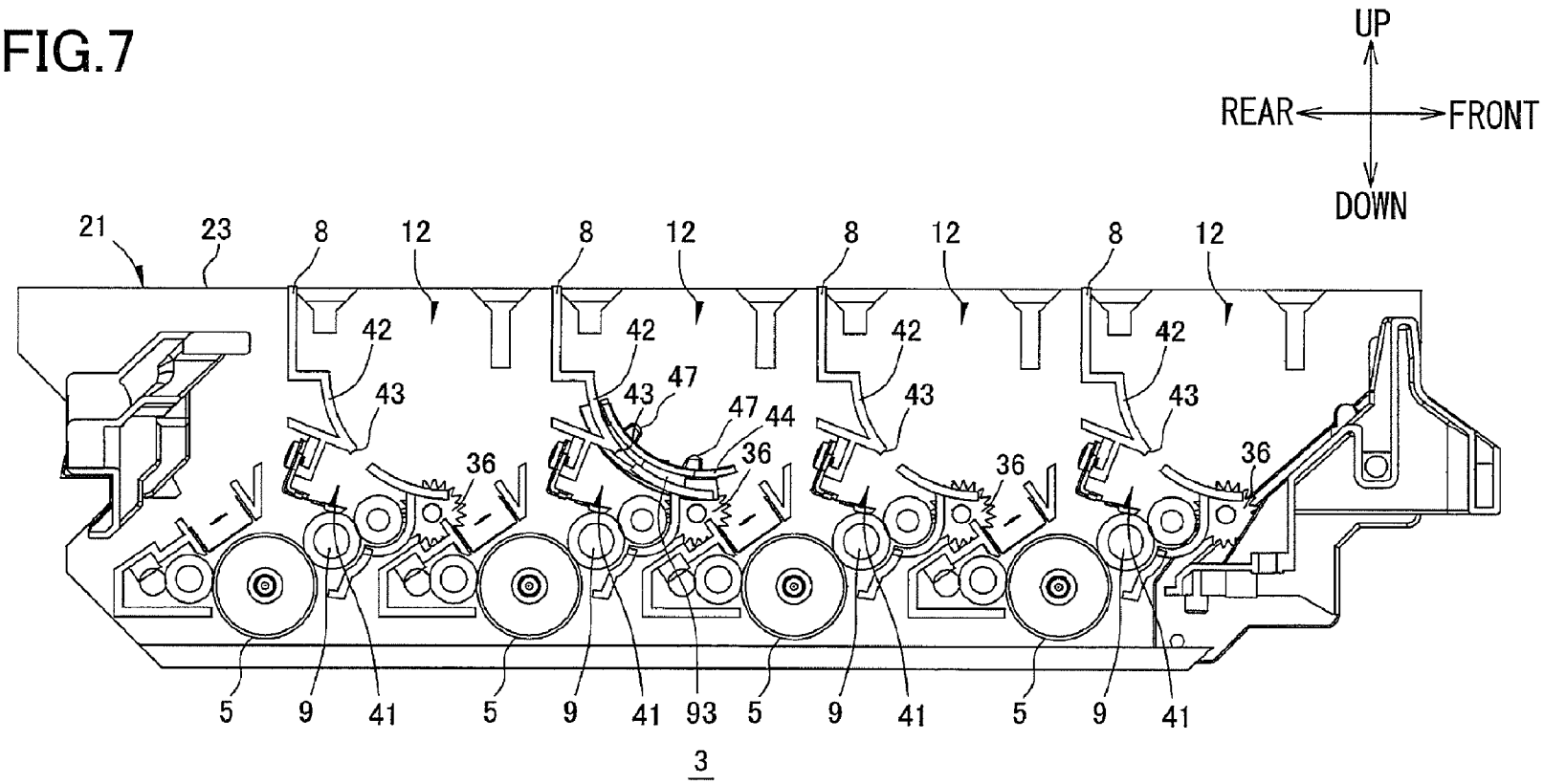
FIG. 7 is a cross-sectional view of the drawer unit taken along the cross-sectional line VII-VII shown in FIG. 6.

As shown in FIG. 7, a developing chamber 41 is formed in each developing unit frame 8 for accommodating the developing roller 9. The side of the developing chamber 41 opposing the corresponding photosensitive drum 5 is open. The developing roller 9 is disposed in the bottom of the developing chamber 41 near the open side thereof.

The developing unit frame 8 also has a plate-shaped partitioning wall 42 positioned between the developing chamber 41 and the space 12. The partitioning wall 42 curves in an arc shape with its convex side facing the developing chamber 41. The partitioning wall 42 partitions the interior of the developing unit frame 8 into the developing chamber 41 and the space 12 formed above the developing chamber 41. As shown in FIG. 2, three rectangular openings 43 are formed in the circumferential center of the partitioning wall 42. The rectangular openings 43 are formed at positions opposing three main-body-side communication through-holes 58 (described later with reference to FIG. 11) formed in the toner box 11 when the toner box 11 is mounted in the space 12.

(6) Shutter Drive Member

As shown in FIGS. 6 and 7, a shutter drive member 44 is movably disposed above the partitioning wall 42 for driving a shutter 73 described later.

Figure 8:
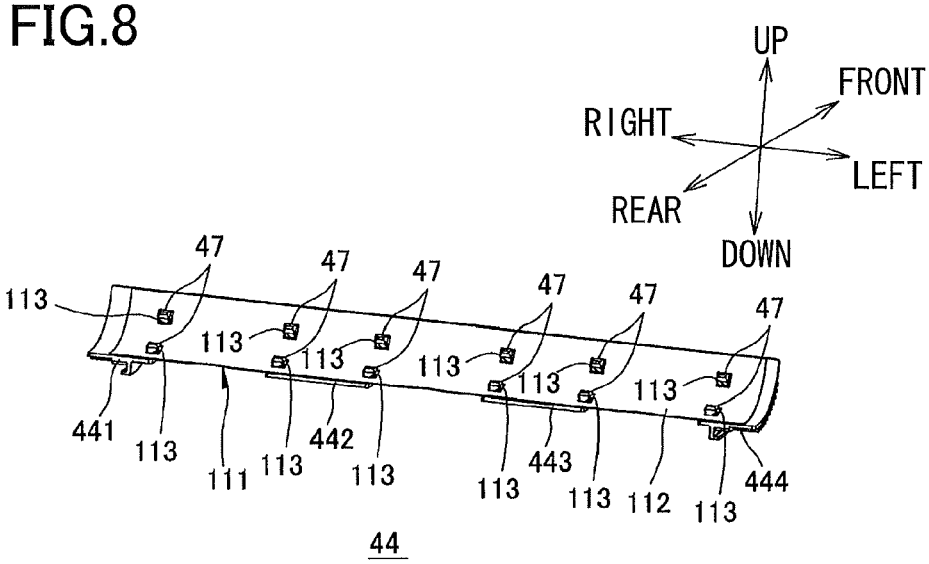
FIG. 8 is a perspective view of a shutter drive member shown in FIG. 6.

As shown in FIG. 8, the shutter drive member 44 includes a main body part 111 (resin plate) formed of a resin, and a reinforcing plate 112 (metal plate) formed of a thin metal plate that is affixed to the main body part 111.

Figure 9:
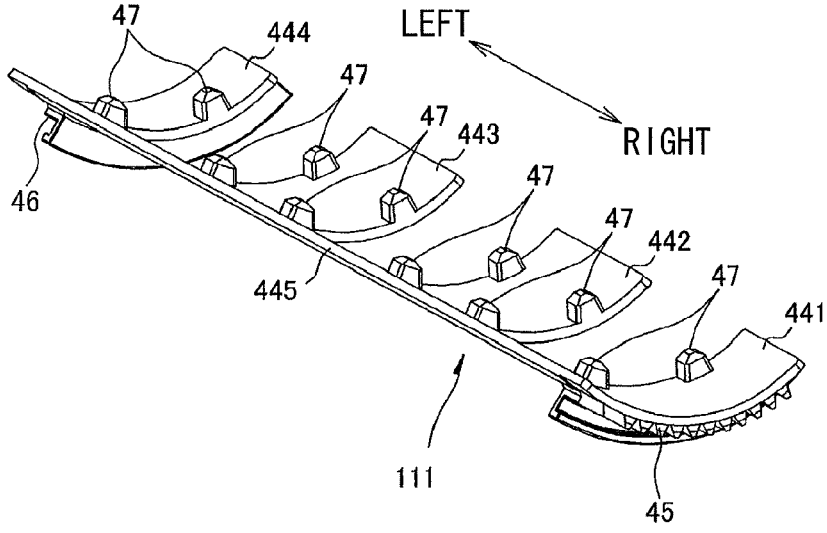
FIG. 9 is a perspective view of a main body part of the shutter drive member shown in FIG. 8.

As shown in FIG. 9, the main body part 111 is integrally configured of four plate-shaped parts 441, 442, 443, and 444 arranged at intervals in the left-to-right direction; and a coupling part 445 having a bar shape that extends in the left-to-right direction for coupling the front edges of the plate-shaped parts 441-444. Each of the plate-shaped parts 441-444 is formed of a plate curved in an arc, with the convex side facing the developing chamber 41. The curved arc of the plate-shaped part substantially conforms to the shape of the partitioning wall 42.

The shutter drive member 44 is provided above the partitioning wall 42 of each developing unit frame 8. For simplification, only the shutter drive member 44 disposed above one partitioning wall 42 is shown in FIGS. 6 and 7.

As shown in FIG. 6, the plate-shaped part 444 on the left end confronts the top of the left pinion gear 38. A left rack gear 46 is formed on the bottom surface of the plate-shaped part 444 (the surface opposing the left pinion gear 38) for engaging with the left pinion gear 38.

As shown in FIG. 6, the plate-shaped part 441 on the right end confronts the top of the right pinion gear 39. A right rack gear 45 is formed on the bottom surface of the plate-shaped part 441 opposing the right pinion gear 39 and is engaged with the right pinion gear 39.

Upon pivotal movement of the operation member 31, the left and right pinion gears 36 and 37 are rotated to drive the left rack gear 45 and the right rack gear 46. Thus, the shutter drive member 44 is moved to the position in alignment with the openings 43 as shown in FIG. 7 and a frontward position offset from the openings 43.

More specifically, when the first acting portion 33 is pivotally moved from its second position shown in FIG. 4B where the first acting portion 33 is oriented vertically downward to its first position shown in FIG. 4A where the first acting portion 33 is oriented frontward and diagonally downward, the pivot motion is transmitted to the left pinion gear 36 through the coupling gear 38, and intermediary gears 39A, 39B to rotate the left pinion gear 36 along with the rotation of the shaft 35 and the right pinion gear 37. By this rotation, the shutter drive member 44 is moved to the frontward position offset from the openings 43 from the confronting position aligning with the openings 43. In accordance with the movement of the first acting portion 33 from the second position to the first position, the second acting portion 34 is pivotally moved from its fourth position as shown in FIG. 4B where the second acting portion 34 is oriented rearward and diagonally downward to a third position as shown ion FIG. 4A where the second acting portion 34 is oriented vertically downward.

Next, when the second acting portion 34 is pivotally moved from the third position to the fourth position, the pivot motion is transmitted to left pinion gear 36 to rotate the left pinion gear 36 along with the rotation of the shaft 35 and the right pinion gear 37. By this rotation, the shutter drive member 44 is moved rearward to the confronting position aligning with the opening from the offset position. In accordance with the movement of the second acting portion 34 from the third position to the fourth position, the first acting portion 33 is pivotally moved from the first position to the second position.

Shutter drive protrusions 47 are formed on the top surfaces of the plate-shaped parts 441-444 at positions corresponding to shutter drive openings 88 described later.

The reinforcing plate 112 covers the entire region of the main body part 111, excluding the right edge of the plate-shaped part 441 and the left edge of the plate-shaped part 444. Insertion through-holes 113 are formed in the reinforcing plate 112 at positions overlapping the shutter drive protrusions 47. Each of the shutter drive protrusions 47 is inserted through a corresponding insertion through-hole 113 and protrudes upward from the reinforcing plate 112.

By overlaying the reinforcing plate 112 on the main body part 111 in this way, it is possible to ensure sufficient rigidity of the shutter drive member 44 so that the shutter drive member 44 can move the shutter 73 described later with reference to FIG. 11 with sufficient stability.

Further, by inserting the shutter drive protrusions 47 through the insertion through-holes 113 in the reinforcing plate 112, the position of the reinforcing plate 112 relative to the main body part 111 remains fixed with the shutter drive protrusions 47 protruding from the reinforcing plate 112.

Since the three rectangular openings 43 formed in the partitioning wall 42 are opened and closed by the reinforcing plate 112 moving in association with the shutter drive member 44, the reinforcing plate 112 functions as a developing-device-side shutter for opening and closing the rectangular openings 43.

3. Toner Box (1) Main Body

Figure 10:
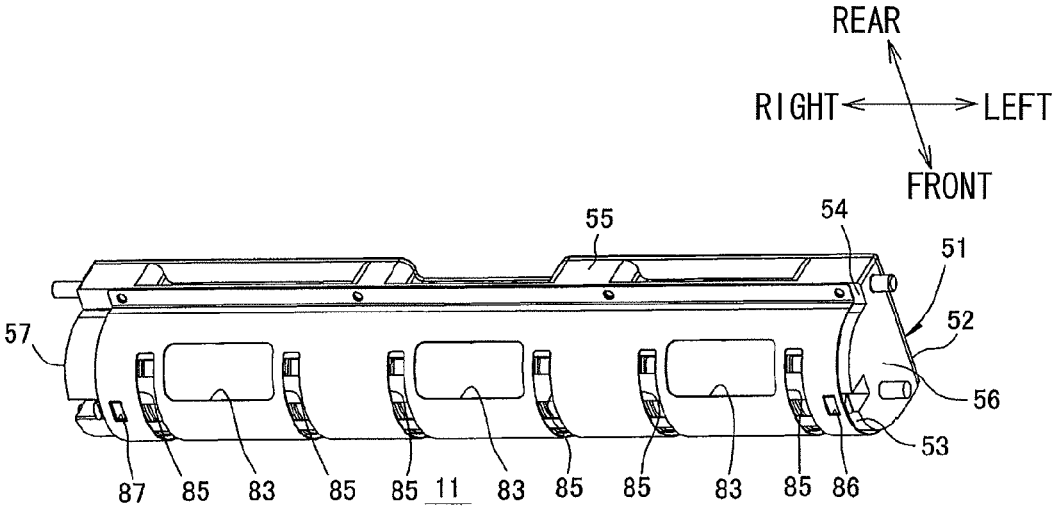
FIG. 10 is a perspective view of one of the toner boxes shown in FIG. 1.
Figure 11:
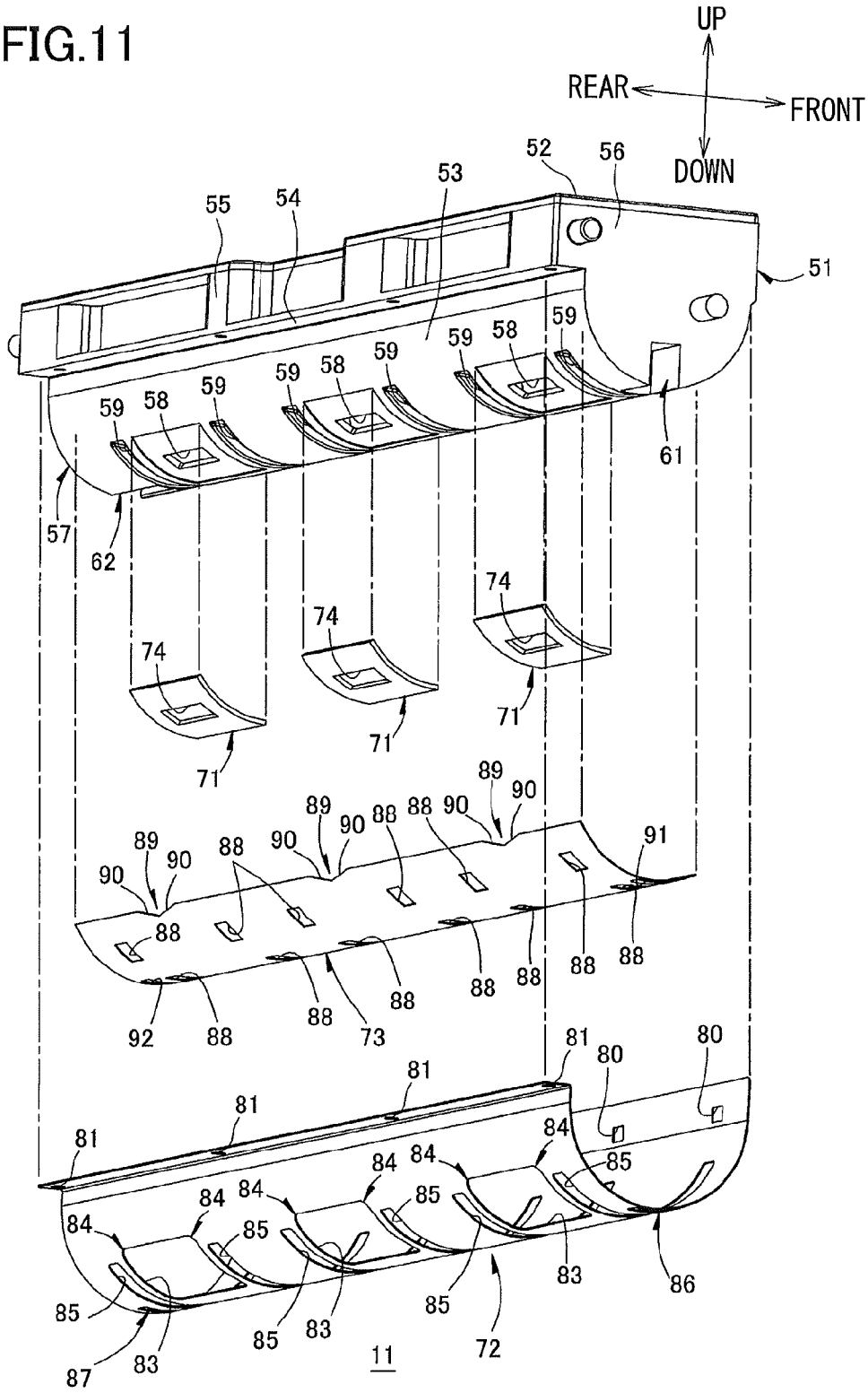
FIG. 11 is an exploded perspective view of the toner box in FIG. 10.

As shown in FIGS. 10 and 11, the toner box 11 includes a main body or toner container 51 for accommodating toner. The main body 51 is formed of a resin material in a substantially hollowed-out semicircular column shape and is elongated in the left-to-right direction. More specifically, the main body 51 has an internal space for accommodating toner that is formed by: a rectangular top surface 52 elongated in the left-to-right direction; an arcing surface 53 that is connected to the front edge of the top surface 52 and that has a substantially semicircular arc shape in a cross section with the convex side facing downward; a fixing surface 54 extending parallel to the top surface 52 and protruding rearward from the rear edge of the arcing surface 53; a rear surface 55 bridging the rear edge of the top surface 52 and the rear edge of the fixing surface 54; a left side surface 56 bridging the respective left edges of the top surface 52, arcing surface 53, fixing surface 54 and rear surface 55; and a right side surface 57 bridging the respective right edges of the top surface 52, arcing surface 53, fixing surface 54, and rear surface 55.

As shown in FIG. 11, three main-body-side communication through-holes (openings) 58 are formed in the arcing surface 53 of the main body 51 at positions slightly rearward of the lowest end thereof. The main-body-side communication through-holes 58 are rectangular in shape and elongated in the left-to-right direction and are spaced at intervals in the left-to-right direction. The main-body-side communication through-holes 58 provide communication between the interior and exterior of the main body 51.

Narrow slit-shaped relief grooves 59 are also formed in the arcing surface 53. The relief grooves 59 extend in the peripheral direction of the arcing surface 53 and are formed one on each of the left and right sides of each main-body-side communication through-hole 58.

Figure 15A:
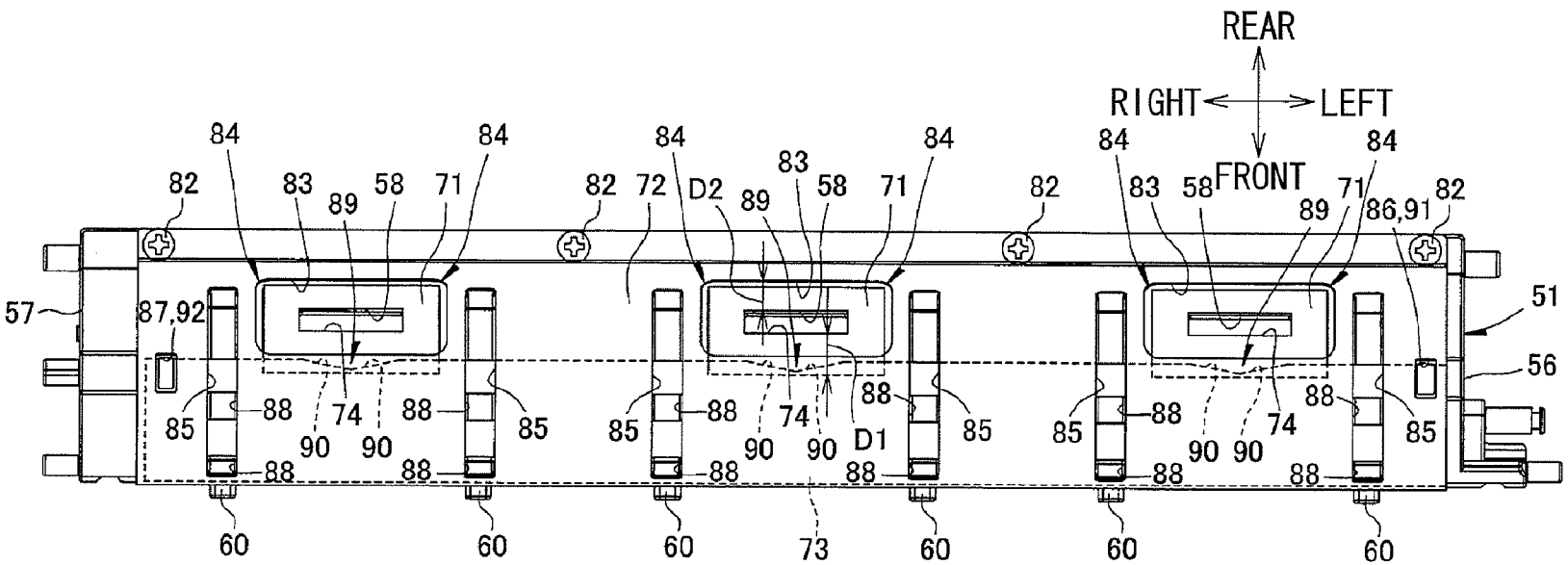
FIG. 15A is a bottom view of the toner box in FIG. 10 when the shutter is in the open position.
Figure 15B:
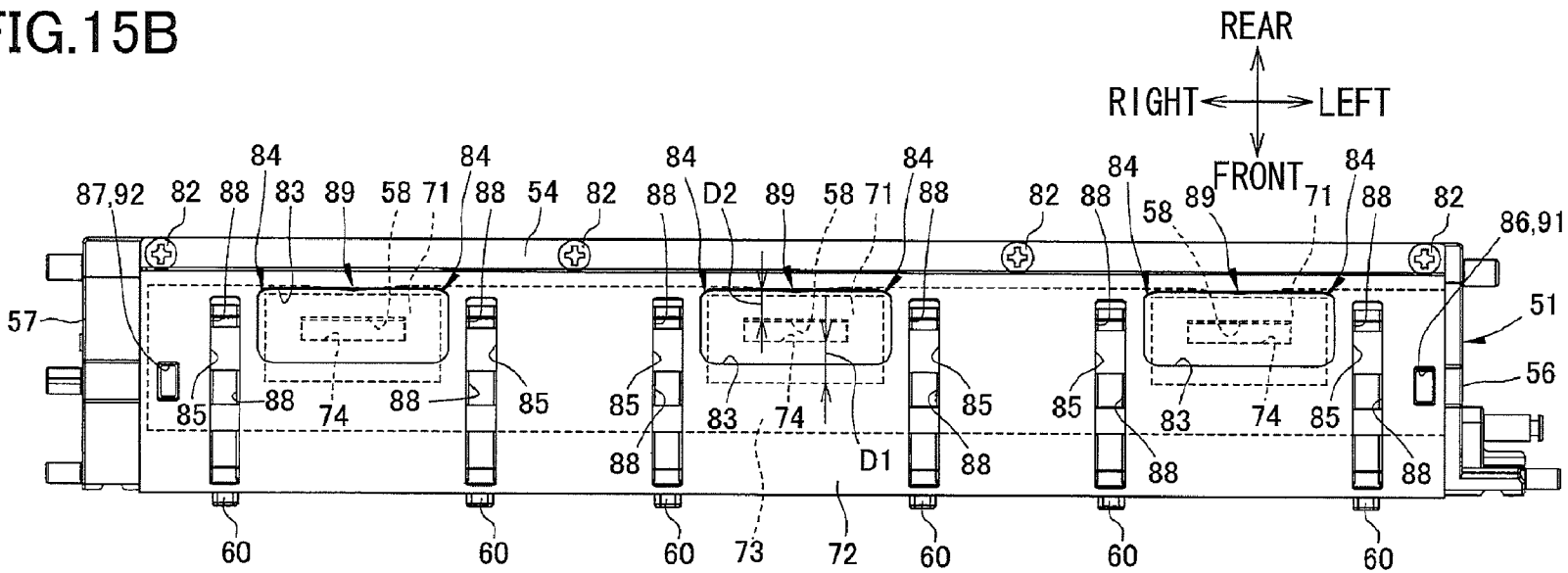
FIG. 15B is a bottom view of the toner box when the shutter is in the closed position.
Figure 16A:
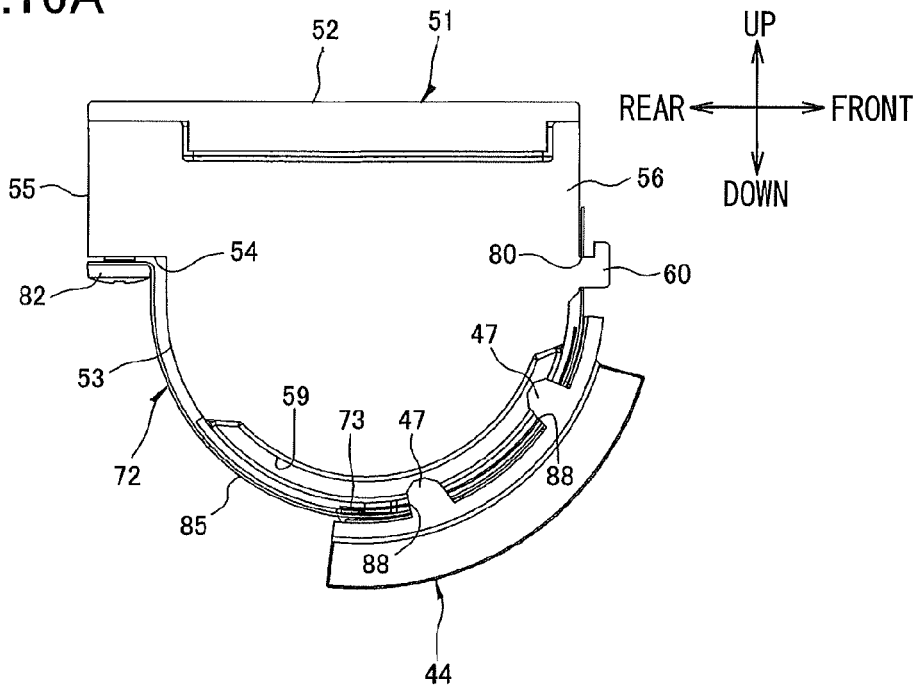
FIG. 16A is a cross-sectional view of the toner box in FIG. 10 and the shutter drive member in FIG. 7 when the shutter is in the open position.
Figure 16B:
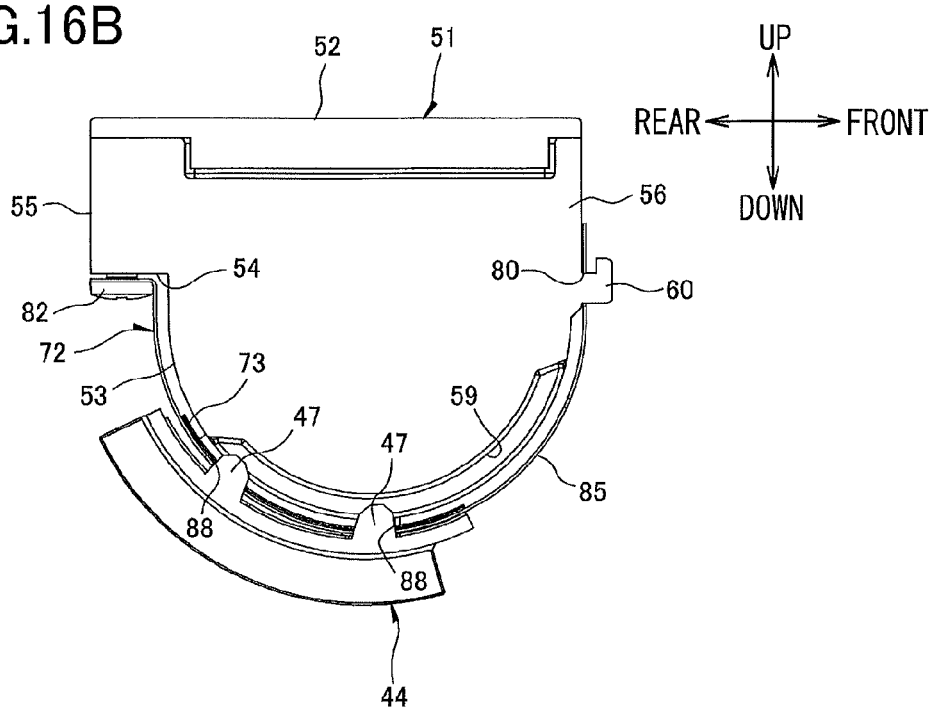
FIG. 16B is a cross-sectional view of the toner box in FIG. 10 and the shutter drive member in FIG. 7 when the shutter is in the closed position.

As shown in FIGS. 15A and 15B, a plurality of positioning protrusions 60 is formed on the front edge of the arcing surface 53. The positioning protrusions 60 are spaced at intervals in the left-to-right direction. As shown in FIGS. 16A and 16B, each positioning protrusion 60 has a hook shape, extending forward, then bending and extending upward.

As shown in FIG. 11, recessions 61 and 62 are respectively formed in the left and right ends of the main body 51 in the lowest portion of the arcing surface 53. The recession 61 on the left side is open in the left side surface 56 of the main body 51, while the recession 62 on the right side is open in the right side surface 57 of the main body 51.

The toner box 11 further includes toner seals 71 affixed to the arcing surface 53 of the main body 51, a shutter cover 72 disposed so as to cover the arcing surface 53, and a shutter 73 disposed between the arcing surface 53 and shutter cover 72.

(2) Toner Seals

As shown in FIG. 11, one of the toner seals 71 is provided for each main-body-side communication through-hole 58. The toner seal 71 has a sheet-like form and is formed with an opening or through-hole 74 at a position corresponding to the main-body-side communication through-hole 58. The area of the opening 74 is greater than the area of the main-body-side communication through-hole 58. Thus, the toner seals 71 are fixed to the arcing surface 53 of the main body 51 so that the openings 74 are aligned and in communication with the corresponding main-body-side communication through-holes 58 and, hence, encircle the main-body-side communication through-holes 58.

Figure 12:
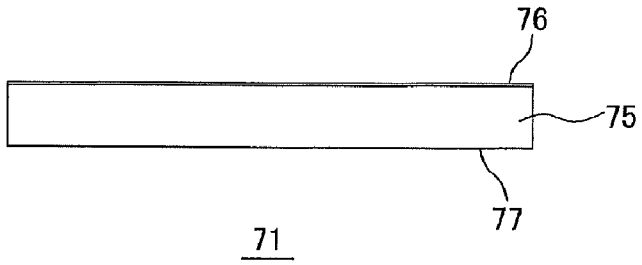
FIG. 12 is a side view of a toner seal shown in FIG. 11.

As shown in FIG. 12, each toner seal 71 has a laminated structure (two-layer structure) configured of an elastic layer 75, and a mesh layer 76 disposed on one surface of the elastic layer 75.

The elastic layer 75 is formed of a resilient foam material, such as the product PORON® (trade name, registered trade mark) manufactured by Rogers Inoac Corporation. The elastic layer 75 is formed much thicker than the mesh layer 76. A fixing surface 77 constituting the surface of the elastic layer 75 opposite the mesh layer 76 is fixed to the arcing surface 53 of the main body 51 with adhesive.

Figure 13:
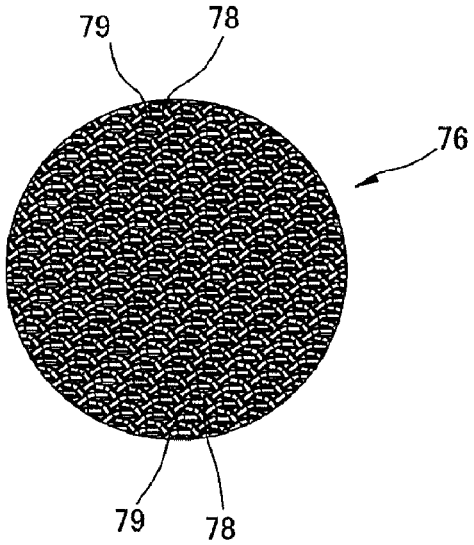
FIG. 13 is a partial perspective view of the surface of a mesh layer shown in FIG. 12.
Figure 14:
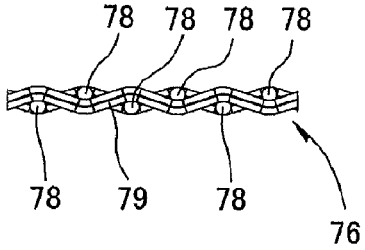
FIG. 14 is a cross-sectional view of the mesh layer.

FIG. 13 shows a surface portion of the mesh layer 76, while FIG. 14 shows a cross-sectional portion of the same. As shown in the drawings, the mesh layer 76 includes warp fibers 78 and weft fibers 79 interlaced in a plain weave (an alternating over and under pattern).

As shown in FIGS. 15A and 15B, the portion of the toner seal 71 disposed forward of the main-body-side communication through-hole 58 (on the front end side of the arcing surface 53) has a width D1 along the circumferential direction of the arcing surface 53. The portion of the toner seal 71 disposed rearward of the main-body-side communication through-hole 58 (on the rear end side of the arcing surface 53) has a width D2 along the circumferential direction of the arcing surface 53. The width D1 is greater than the width D2.

(3) Shutter Cover

The shutter cover 72 is curved to conform to the arcing surface 53 of the main body 51. The shutter cover 72 is formed of a resin film. The shutter cover 72 has a thickness greater than or equal to 0.03 mm and smaller than or equal to 0.3 mm, and preferably greater than or equal to 0.08 mm and smaller than or equal to 0.2 mm. The left-to-right dimension of the shutter cover 72 is approximately equal to the same dimension of the arcing surface 53, so that the shutter cover 72 covers the arcing surface 53 across substantially the entire width in the left-to-right direction.

As shown in FIG. 11, a plurality of positioning openings 80 is formed in the front edge portion of the shutter cover 72 at intervals in the left-to-right direction. As shown in FIGS. 16A and 16B, the positioning protrusions 60 formed on the arcing surface 53 of the main body 51 are engaged in the positioning openings 80. More specifically, the positioning openings 80 are formed in the front edge portion of the shutter cover 72 at positions in the left-to-right direction corresponding to the positioning protrusions 60 and of a sufficient size for inserting the positioning protrusions 60. After the positioning protrusions 60 are inserted into the corresponding positioning openings 80, the top edges of the positioning openings 80 engage the positioning protrusions 60.

The rear edge part of the shutter cover 72 is folded back to conform to the fixing surface 54 of the main body 51. A plurality of screw insertion through-holes 81 are formed in this rear edge portion of the shutter cover 72 at intervals in the left-to-right direction, as shown in FIG. 11. As shown in FIGS. 15A and 15B, the shutter cover 72 is attached to the main body 51 by engaging the positioning protrusions 60 in the respective positioning openings 80, and by inserting screws 82 through all of the screw insertion through-holes 81 and screwing the tips of the screws 82 into the fixing surface 54 of the main body 51.

As shown in FIGS. 10 and 11, cover-side communication through-holes 83 are fanned in the shutter cover 72 at positions corresponding to the toner seals 71. Each of the cover-side communication through-holes 83 has a rectangular shape and is elongated in the left-to-right direction. Further, the cover-side communication through-hole 83 has a greater open area than the area of the main-body-side communication through-hole 58 so as to expose the main-body-side communication through-hole 58 in its entirety. The size of each cover-side communication through-hole 83 is such that when the shutter 73 is in an open position (described later), as shown in FIG. 15A, a gap is formed between the rear edge of the corresponding toner seal 71 and the rear edge of the cover-side communication through-hole 83, gaps are formed between the left and right edges of the corresponding toner seal 71 and the left and right edges of the cover-side communication through-hole 83, and the front edge portion of the corresponding toner seal 71 is interposed between the shutter cover 72 and the arcing surface 53 of the main body 51. Consequently, when the shutter 73 is in the open position, the shutter cover 72 does not cover the rear edge and both left and right edges of the toner seal 71, allowing these edges to protrude outward through the cover-side communication through-hole 83.

As shown in FIG. 11, slanted parts 84 having portions angled relative to the circumferential direction of the shutter cover 72 are formed on the shutter cover 72 in both rear side corners of each cover-side communication through-hole 83 as part of the peripheral edge of the cover-side communication through-hole 83. With the slanted parts 84, the left-to-right width of each cover-side communication through-hole 83 grows narrower toward the rear edge of the shutter cover 72.

The part of each slanted part 84 forming a peripheral edge portion of each cover-side communication through-hole 83 may extend in a straight line or follow a gentle curve, provided that the portion is slanted relative to the circumferential direction of the shutter cover 72. These portions of the slanted parts 84 are shaped in a gentle curve in the example of FIG. 11.

Guide slits 85 elongated in the front-to-rear direction (circumferential direction of the shutter cover 72) are formed in the shutter cover 72 at positions corresponding to the relief grooves 59 formed in the main body 51. The guide slits 85 have a front-to-rear length that is greater than or equal to the front-to-rear length of the relief grooves 59. The left-to-right width of the guide slits 85 is also greater than or equal to the left-to-right width of the relief grooves 59. Each guide slit 85 confronts the corresponding relief groove 59 in its entirety.

Locking member insertion through-holes 86 and 87 are also formed in the shutter cover 72 at positions corresponding to the recessions 61 and 62 formed in the main body 51.

(4) Shutter

As shown in FIG. 11, the shutter 73 curves along the arcing surface 53 of the main body 51. The shutter 73 is formed of a resin film having a width in the left-to-right direction slightly smaller than the left-to-right width of the shutter cover 72. The dimension of the shutter 73 along the circumferential direction of the arcing surface 53 is greater than the same dimension of the toner seals 71 and is set such that the shutter 73 does not contact the fixing surface 54 and the positioning protrusions 60 when moving between an open position and a closed position described later.

Two shutter drive openings 88 separated by a prescribed interval in the circumferential direction of the shutter 73 are formed in the shutter 73 at positions opposing each relief groove 59 in the main body 51. The distance between the two shutter drive openings 88 at each position is set such that all shutter drive openings 88 confront a corresponding relief groove 59 and confront and communicate with a corresponding guide slit 85 formed in the shutter cover 72, regardless of whether the shutter 73 is in the open position or the closed position.

V-shaped notches 89 are formed in the rear edge of the shutter 73 (the edge of the shatter 73 on the rear edge side of the arcing surface 53) at positions in the left-to-right direction corresponding to the main-body-side communication through-holes 58 formed in the main body 51. The V-shaped notches 89 open toward the rear edge side of the arcing surface 53. Forming the V-shaped notches 89 in this way, produces sloped parts 90 in the rear edge of the shutter 73 that are angled relative to the circumferential direction of the shutter 73.

Locking openings 91 and 92 are also formed in the shutter 73 at positions opposing the recessions 61 and 62 formed in the main body 51 when the shutter 73 is in the closed position. Hence, when the shutter 73 is in the closed position, the locking openings 91 and 92 confront the recessions 61 and 62, respectively, and also confront the respective locking member insertion through-holes 86 and 87 formed in the shutter cover 72. Accordingly, the recession 61 and locking member insertion through-hole 86 are in communication via the locking opening 91, and the recession 62 and locking member insertion through-hole 87 are in communication via the locking opening 92.

The shutter 73 is interposed between the arcing surface 53 of the main body 51 and the shutter cover 72. While held between the arcing surface 53 and shutter cover 72, the shutter 73 can move between an open position and a closed position described next.

(5) Open Position of the Shutter

In the open position shown in FIG. 15A, the shutter 73 is positioned on the front side of the cover-side communication through-holes 83 formed in the shutter cover 72. More specifically, when the shutter 73 is in the open position, the rear edge of the shutter 73 is positioned farther forward than the front edges of the cover-side communication through-holes 83, and the rear edge portion of the shutter 73 is interposed between the front edge portion of the toner seal 71 and the shutter cover 72. Therefore, each main-body-side communication through-hole 58 formed in the main body 51 and the opening 74 formed in the corresponding toner seal 71 are made open, while being in communication with each other. This provides communication between the interior and exterior of the main body 51. Further, since the rear edge and both left and right edges of the toner seal 71 are exposed, these edges protrude outward through the cover-side communication through-hole 83.

(6) Closed Position of the Shutter

In the closed position shown in FIG. 15B, the shutter 73 is positioned farther rearward than the open position. When the shutter 73 is in the closed position, the rear edge of the shutter 73 is positioned slightly rearward than the rear edges of the cover-side communication through-holes 83. Accordingly, the shutter 73 opposes nearly the entire area of the cover-side communication through-holes 83, excluding the regions opposite part of the V-shaped notches 89 formed in the shutter 73. The toner seals 71 are entirely interposed between the shutter 73 and the arcing surface 53 of the main body 51. As a result, the shutter 73 covers the main-body-side communication through-holes 58 formed in the main body 51 and the openings 74 formed in the toner seals 71 in their entirety, blocking communication between the interior and exterior of the main body 51.

4. Mounting the Toner Box

Each toner box 11 is mounted in or removed from the corresponding space 12 formed above the partitioning wall 42 of the developing unit frame 8 (see FIG. 6) when the corresponding shutter 73 is in the closed position.

In a state where the toner box 11 has not been provided in the space 12, as shown in FIG. 4B, the first acting portion 33 is at the second position such that the tip end portion of the first acting portion 33 is positioned in the gap 116 between the cover 111 and the thin plate portion 115. Further, as shown in FIGS. 6 and 7, the shutter drive member 44 positioned above the partition wall 42 is positioned in confrontation with the openings 43 formed in the partition wall 42.

With the drawer unit 3 (drawer frame 21) pulled out of the main casing 2 to the pull-out position (see FIG. 1), the toner box 11 is mounted into the corresponding space 12 from above. More specifically, when the drawer unit 3 is at the pull-out position, the spaces 12 for all the four colors are located outside of the main casing 2. So, the toner boxes 11 for all the four colors can be mounted to and detached from the drawer unit 3. At this time, the shutter drive protrusions 47 positioned closer to the front side among the pairs of shutter drive protrusions 47 formed in the shutter drive member 44 protrude upward along a substantially vertical direction, while the shutter drive protrusions 47 positioned closer to the rear protrude in a direction angled upward and forward, as shown in FIG. 16B. When the toner box 11 is mounted in the space 12, each of the shutter drive protrusions 47 engages in a corresponding shutter drive opening 88 through the corresponding guide slit 85.

Then, when the drawer unit 3 is moved from the pull-out position toward the accommodated position, the abutment member 117 approaches the gap 116 between the cover 111 and the thin plate portion 115, and the abutment member 117 enters into the gap 116 from a rear end thereof, and the abutment member 117 passes through the gap 116 in accordance with the further movement of the drawer unit 3. During this movement, the abutment member 117 is successively brought into contact with the first acting portions 33 so that the first acting portions 33 are pivotally moved from their second position to the first position by the pushing force of the abutment member 117. In accordance with the movement of the first acting portions 33, the shutter drive member 44 is moved from the confronting position confronting the openings 43 to the offset position out of confrontation with the openings 43 as shown in FIG. 16A. Thus, the shutter 73 is moved frontward along with the shutter drive member 44 from the closed position to the open position. In this case, the second acting portion 34 is moved from the fourth position (FIG. 4B) to the third position (FIG. 4A).

As shown in FIG. 7, annular frame seals 93 are disposed on top of the partitioning wall 42 at positions corresponding to each of the toner seals 71. That is, the annular frame seals 93 are disposed on a surface of the partitioning wall 42 confronting the corresponding space 12 at positions corresponding to each of the toner seals 71. The annular frame seals 93 surround the periphery or perimeter of each rectangular opening 43. When the shutter 73 is in the open position, the rear edge and both left and right edges of each toner seal 71 protrudes outward through the corresponding cover-side communication through-hole 83. The protruding portions of the toner seal 71 directly press against the corresponding frame seal 93, and portions of the frame seal 93 that do not contact the toner seal 71 contact the shutter cover 72. Therefore, the opening 74 formed in each toner seal 71 is in communication with the corresponding rectangular opening 43 through the opening region in the corresponding frame seal 93, while the toner seal 71 and frame seal 93 seal any gaps formed between the partitioning wall 42 and shutter cover 72.

When shutters 73 of all toner boxes 11 are moved to the open position, toner in each toner box 11 is supplied to associated developing unit 7. Then, image forming operation can be started after closing the front cover 4.

When the toner box 11 is to be removed from the drawer unit 3, the drawer unit 3 is drawn out from the accommodated position toward the pull-out position after opening the front cover 4. In this movement, the abutment member 117 is moved through the gap 116 from its front end portion to the rear end portion as shown in FIG. 4A. During this movement, the abutment member 117 is successively brought into abutment with the second acting portions 34, so that each acting portion 34 is moved from the third position (FIG. 4A) to the fourth position (FIG. 4B) by pushing force from the abutment member 117. Consequently, the shutter drive member 44 is moved from the offset position (out of confrontation with the openings 43) to the confronting position confronting the openings 43 as shown in FIG. 16B. Thus, the shutters 73 are moved rearward along with the shutter drive members 44 from their open position to the closed position Next, the operator removes the toner box 11 from the space 12. Since the shutter 73 is in the closed position at this time, there is no risk of toner spilling out of the main body 51 when the toner box 11 is removed.

5. Locking Mechanism

Since the shutter drive protrusions 47 are not engaged in the shutter drive openings 88 when the toner box 11 has been removed from the drawer unit 3, the shutter 73 can move freely relative to the main body 51 and shutter cover 72. Therefore, if the toner box 11 were jolted, shaken, or the like, the shutter 73 could move out of the closed position.

Figure 17A:
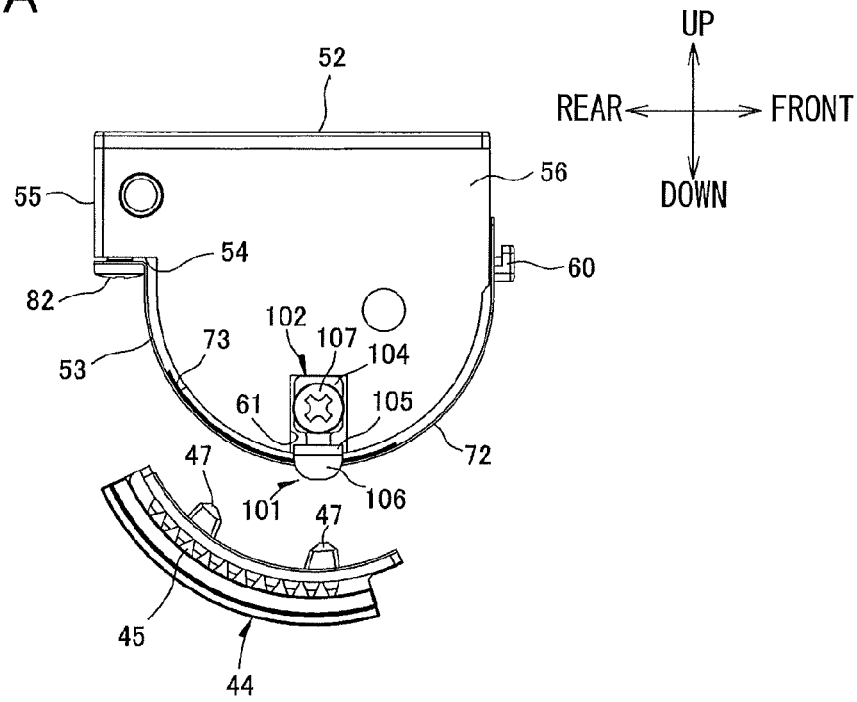
FIG. 17A is a left side view of the toner box in FIG. 10 and the shutter drive member in FIG. 7 showing the state of a locking mechanism before the toner box has been coupled with the shutter drive member.
Figure 17B:
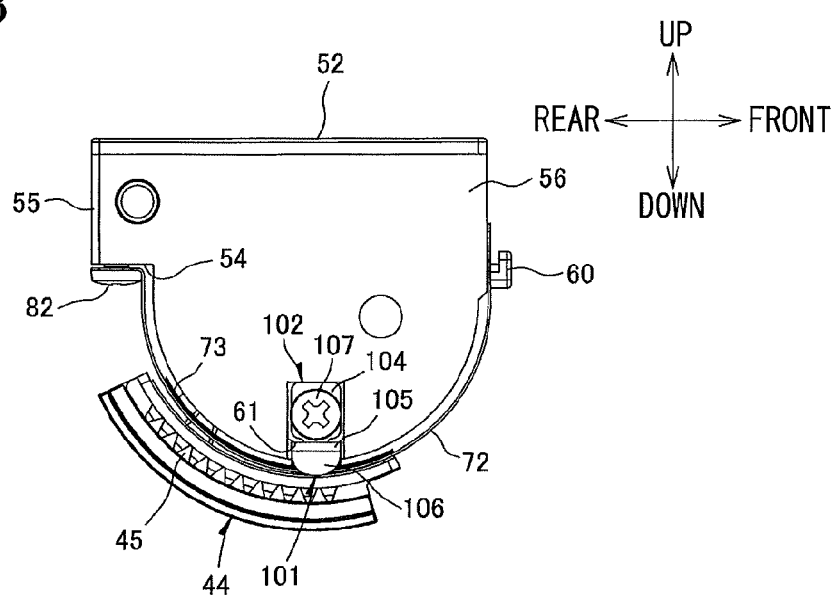
FIG. 17B is a left side view of the toner box in FIG. 10 and the shutter drive member in FIG. 7 showing the state of the locking mechanism after the toner box has been coupled with the shutter drive member.

In order to fix the shutter 73 in the closed position while the toner box 11 is removed from the drawer unit 3, the toner box 11 in the embodiment has a locking mechanism 101 provided in each of the recessions 61 and 62, as shown in FIGS. 17A and 17B. Since the locking mechanism 101 disposed in the recession 61 and the locking mechanism 101 disposed in the recession 62 have the same structure, except in mirror image, the locking mechanism 101 disposed in the recession 61 will be used below for a collective description of the locking mechanisms 101.

Figure 18:
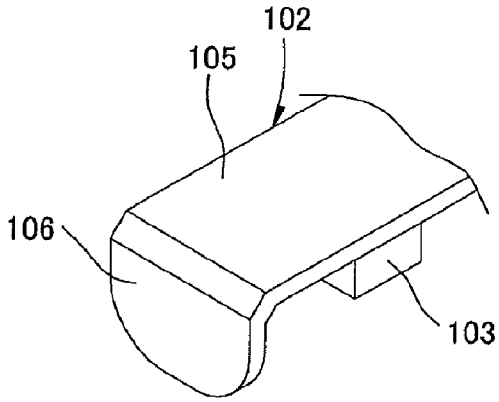
FIG. 18 is a partial perspective view of the locking mechanism shown in FIGS. 17A and 17B.

As shown in FIG. 18, the locking mechanism 101 includes an arm 102, and a locking protrusion 103 attached to the arm 102.

The arm 102 is configured of a flexible thin plate, such as a leaf spring. The arm 102 has the shape of a crank. That is, beginning from one end, the arm 102 extends downward within the recession 61, then bends and extends leftward, and finally bends and extends downward. More specifically, as shown in FIGS. 17A and 17B, the arm 102 is integrally formed of a fixing part 104 extending downward within the recession 61, a holding part 105 extending leftward from the bottom edge of the fixing part 104, and a contact part 106 extending downward from the left edge of the holding part 105. The fixing part 104 is fixed to the leftward-facing surface of the main body 51 inside the recession 61 by a screw 107.

As shown in FIG. 18, the locking protrusion 103 has a flattened square pillar shape and is fixed to the bottom surface of the holding part 105. When the shutter 73 is in the closed position, the locking protrusion 103 on the bottom surface of the holding part 105 is disposed in a position opposing the locking opening 91 formed in the shutter 73.

Figure 19A:
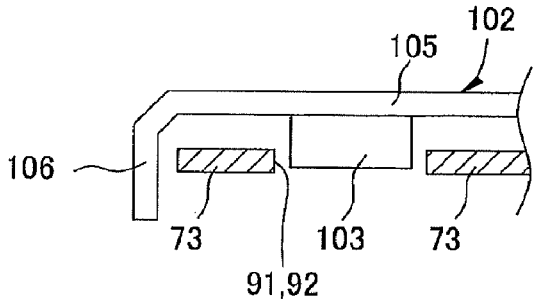
FIG. 19A is a cross-sectional view of the shutter and locking mechanism when the shutter is fixed by the locking mechanism.

Accordingly, when the toner box 11 has been removed from the drawer unit 3, the locking protrusions 103 of both locking mechanisms 101 are respectively inserted into the locking openings 91 and 92 formed in the shutter 73, as shown in FIGS. 17A and 19A, thereby preventing the shutter 73 from moving out of the closed position. Accordingly, the locking mechanisms 101 prevent the shutter 73 from moving out of the closed position while the toner box 11 has been removed from the drawer unit 3.

Figure 19B:
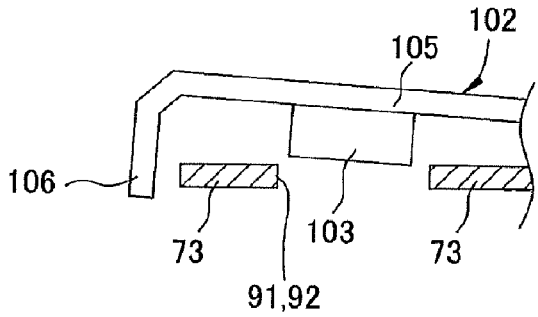
FIG. 19B is a cross-sectional view of the shutter and locking mechanism when the shutter is not fixed by the locking mechanism.

When the toner box 11 is mounted in a corresponding space 12 provided in the drawer unit 3, the bottom edge of the contact part 106 contacts the top surface of the shutter drive member 44 (the top surface of the plate-shaped part 441 or 444) during the mounting operation, as shown in FIGS. 17B and 19B. Thus, as the toner box 11 is moved farther in the mounting direction, the force of resistance received from the shutter drive member 44 causes the holding part 105 of the arm 102 to deform, bending so that the left end of the holding part 105 rises upward. Consequently, the locking protrusions 103 are extracted from the locking openings 91 and 92. At this time, the shutter 73 can move freely relative to the main body 51 and shutter cover 72 and can move together with the shutter drive member 44.

6. Operations (1) According to the above described embodiment, the drawer unit 3 (drawer frame 21) is movable between the accommodated position in the main casing 2 and the pull-out position, in which the drawer unit 3 is partly outside the main casing 2, but is still partly staying in the main casing 2. The plurality of photosensitive drums 5 are held in the drawer frame 21 and are spacedly arrayed side by side in the frontward/rearward direction which is the moving direction of the drawer unit 3. Further, the plurality of developing units 7 each corresponding to each photosensitive drum 5 are also held in the drawer frame 21. Further, the plurality of toner boxes 11 is held in the drawer frame 21. Each toner box 11 is provided for each developing unit 7 and is detachably attached to the drawer frame 21 positioned at the pull-out position.

The toner box 11 includes the main body or toner container 51 accommodating toner therein, and the toner container 51 is formed with the openings (main-body-side communication through-holes) 58 for supplying toner to the developing unit 7. Further, the toner box 11 is provided with the shutter 73 movable between open position and closed position for opening and closing the openings 58.

The drawer frame 21 is provided with the first and second acting portions 33, 34. The first acting portion 33 is movable between the first position providing open state of the shutter 73 and the second position providing closed state of the shutter 73. The second acting portion 34 is movable between the third position providing the open state of the shutter 73 and the fourth position providing the closed state of the shutter 73.

The main casing 2 is provided with the abutment member 117. When the drawer unit 3 is on its way to the accommodated position from the pull-out position, the first acting portion 33 abuts the abutment member 117, so that the first acting portion 33 is moved from the second position to the first position in accordance with the further movement of the drawer unit 3. The shutters 73 are at the closed position when the drawer unit 3 is at the pull-out position. However, by the movement of the drawer unit 3 toward the accommodated position, the shutters 7 are moved from their closed position to the open position by way of the movement of the first acting portions 33. On the other hand, when the drawer unit 3 is on its way to the pull-out position from the accommodated position, the second acting portion 34 abuts the abutment member 117, so that the second acting portion 34 is moved from the third position to the fourth position in accordance with the further movement of the drawer unit 3. Thus, the shutters 73 are moved from the open position to the closed position by the movement of the second acting portions 34.

In this way, the movement of the drawer unit 3 causes movement of the first acting portions 33 and the second acting portions 34 for automatically moving the shutters 73 between open position and the closed position. Therefore, operation for moving the shutters 73 is not required after the drawer unit 3 has been moved to the pull-out position. Accordingly, overturning of the color printer 1 caused by opening and closing operation of the shutters can be obviated.

Further, force required for opening and closing the shutters 73 is imparted only within the main casing 2, since the abutment member 117 is provided within the main casing 2. This structure can also prevent the printer 1 from overturning.

Now assume a comparative example where some operation members to be manipulated by a user are provided in an upper portion of the toner box. In such a comparative example, the color printer will possibly be overturned. That is, after the drawer unit is pulled out from the main casing, a center of gravity of the color printer is displaced toward the pull-out side of the drawer unit. In this state, if the operation members in the upper portion of the toner box were operated by a user, the operation will possibly impart a force on the drawer unit, thereby generating rotational moment to the printer. Contrarily, according to the present embodiment, the operation members are not manipulated by the user, and are operated within the main casing 2 at a position close to the center of gravity of the color printer. Overturning of the printer can be prevented.

(2) If the first acting portion 33 and the second acting portion 34 were provided at laterally different positions from each other, two abutment members, one for the first acting portion 33 and the other for the second acting portion 34, would be required. In contrast, in the printer 1 according to the embodiment, the first and second acting portions 33, 34 are arrayed in the frontward/rearward direction, which is the moving direction of the drawer unit 3. With this structure, the abutment of first acting portion 33 against the abutment member 117 stably occurs when the drawer unit 3 is on its way to the accommodated position from the pull-out position, and further, the abutment of the second acting portion 34 against the abutment member 117 also stably occurs when the drawer unit 3 is on its way to the pull-out position from the accommodated position. Thus, only the single abutment member 117 is required to simplify the structure of the color printer 1.

(3) The cover 111 is provided on the left side surface of the left side plate 22 for covering the first acting portion 33 at the first position and the second acting portion 34 at the fourth position. Therefore, manual access to the first and second acting portions 33, 34 at their first and fourth positions can be prevented.

(4) The groove like gap 116 is defined between the cover 111 and the thin plate portion 115 on the left side of the left side plate 22. The abutment member 117 passes through the gap 116 during movement of the drawer unit 3 between the pull-out position and the accommodated position. Thus, abutment of the abutment member 117 against the cover 111 and the thin plate portion 115 can be prevented to smoothly move the drawer unit 3 in the frontward/rearward direction.

An impacting force is generated when the abutment member 117 abuts against the first acting portion 33 or second acting portion 34. So, if the groove like gap 116 were not provided, the abutment member 117 would be offset from the abutting position if the impacting force were excessive. However, according to the depicted embodiment, the gap 116 is provided to guide the abutment member 117 relative to the drawer unit 3. Thus, the abutment member 117 can be stably abutted against the first acting portion 33 or second acting portion 34 without any deviation.

(5) The second acting portion 34 is moved from the fourth position to the third position in accordance with the movement of the first acting portion 33 from the second position to the first position. Further, the first acting portion 33 is moved from the first position to the second position in accordance with the movement of the second acting portion 34 from the third position to the fourth position. Therefore, it is ensured that the first acting portion 33 is positioned at the second position when the drawer unit 3 is to be moved from the pull-out position to the accommodated position, and the second acting portion 34 is positioned at the third position when the drawer unit 3 is to be moved from the accommodated position to the pull-out position.

(6) The free end portions of the first and second acting portions 33, 33 protrude downward from the cover 111 when the first and second acting portions 33, 34 are positioned at the second position and third position, respectively, i.e., when the first and second acting portions 33, 34 are oriented vertically downward. Therefore, the first and second acting portions 33, 34 can accurately abut against the abutment member 117.

Further, the free end portions of the first and second acting portions 33, 33 are positioned above the lower edge of the cover 111 when the first and second acting portions 33, 34 are positioned at the first position and fourth position, respectively. Therefore, manipulation to the first and second acting portions 33, 34 can be avoided.

(7) The drawer frame 21 includes a pair of side plates 22, 23 extending in the moving direction of the drawer frame 21. The pair of side plates 22 and 23 are spaced away from each other defining a space 12 therebetween for accommodation of the toner box 11. The first and second acting portions 33, 34 are positioned outside of the left side plate 22. With this structure, abutment between the acting portions and the abutment member 117 can be easily performed.

(8) Each operation member 31 is provided for each toner box 11, and totally four operation members 31 are provided. Therefore, the shutters 73 of the toner boxes 11 can be moved individually from one another between the open position and closed position.

(9) The drawer unit 3 is provided with the shutter drive member 44.

The shutter drive member 44 is configured to be connectable with the shutter 73 to move the shutter 73 between the open position and the closed position. The shutter drive member 44 is connected to both of the first acting portion 33 and the second acting portion 34. Thus, the shutter driving member 44 can be moved in association with movement of the first acting portion 33 and the second acting portion 34, to thereby move the shutter 73 between the open position and closed position.

7. Modification

Figure 20:
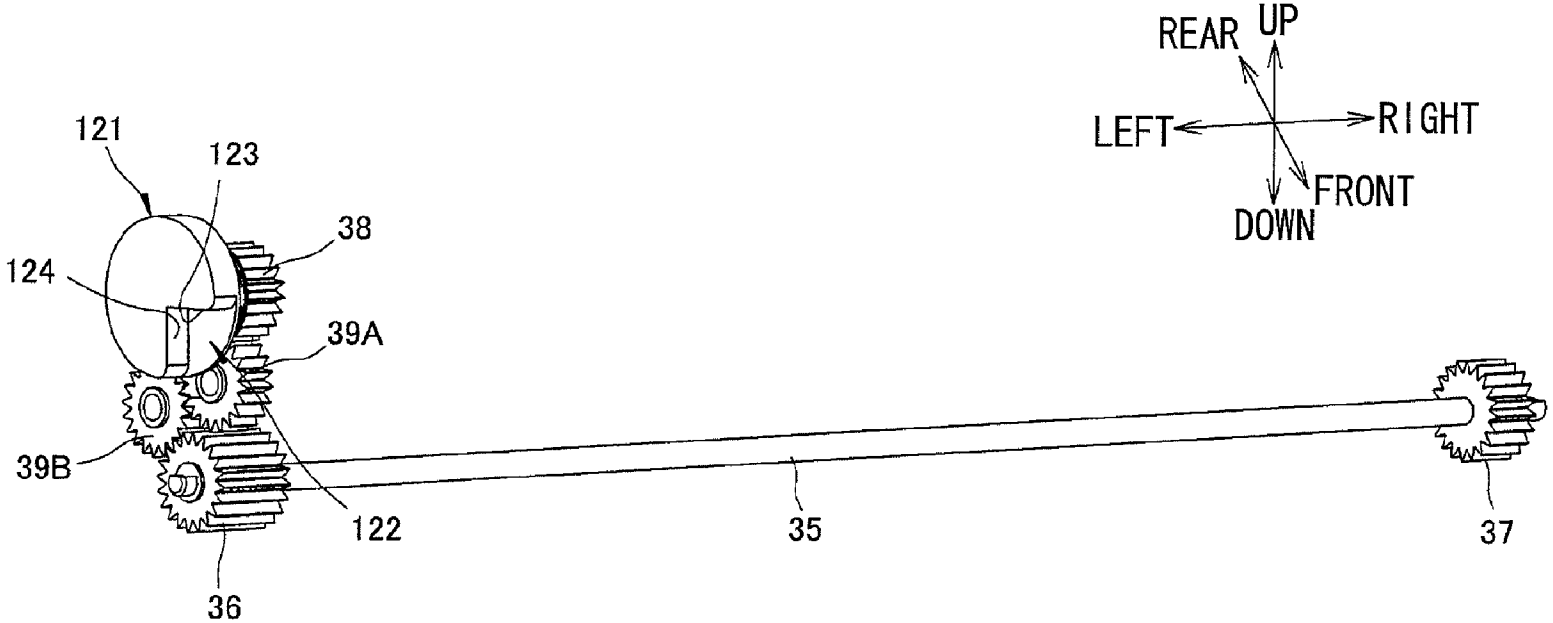
FIG. 20 is a perspective view of an operation member according to a modification.
Figure 21A:
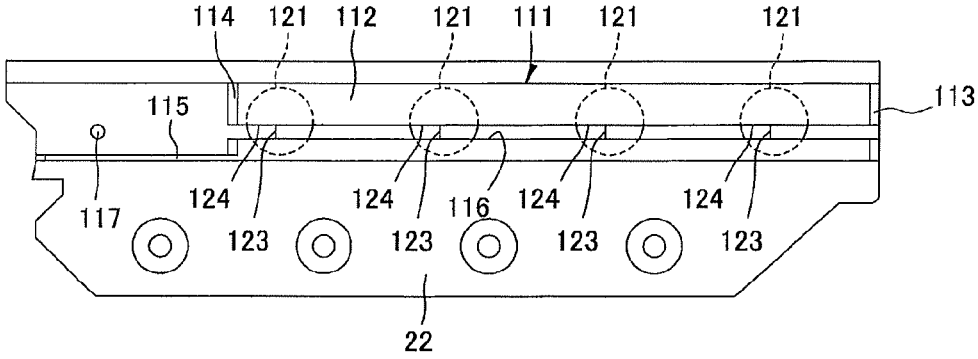
FIG. 21A is a left side view of a drawer unit provided with the operation member shown in FIG. 20, and showing a state where the drawer unit is on its way to an accommodated position from a pull-out position.
Figure 21B:
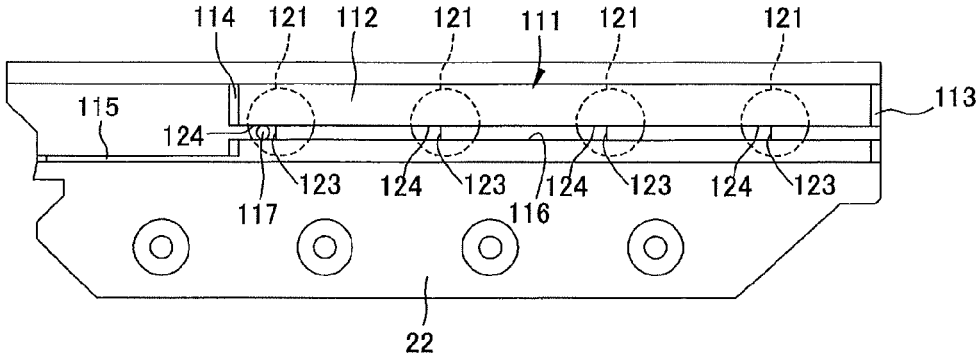
FIG. 21B is a left side view of the drawer unit provided with the operation member shown in FIG. 20, and showing a state subsequent to the state of FIG. 21A; and, FIG. 21C is a left side view of the drawer unit provided with the operation member shown in FIG. 20, and showing a state subsequent to the state of FIG. 21B.
Figure 21C:
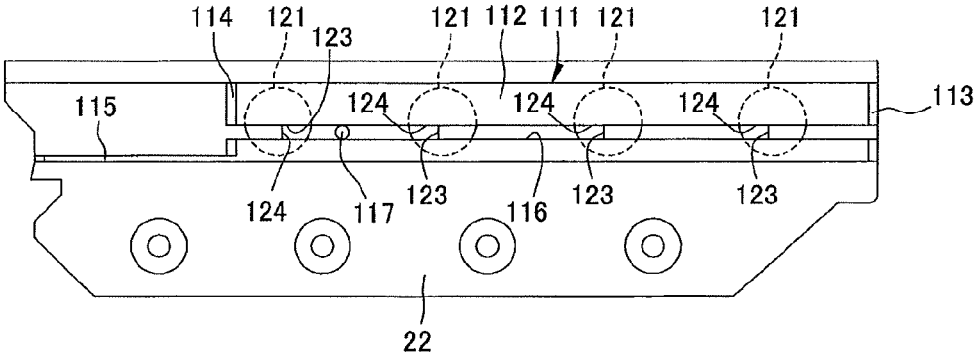

A modification is shown in FIGS. 20 through 21C. This modification pertains to operation members 121 instead of the operation members 31 of the above-described embodiment.

Each operation member 121 shown in FIG. 20 is circular shaped in side view. The operation member 121 has a left side surface formed with a recess 122 of a sector shape whose central angle is approximately 90 degrees. The recess 122 has a first acting surface 123 and a second acting surface 124 those extending in a radial direction of the operation member 121 and angularly spaced away from each other by the central angle of approximately 90 degrees. The first acting surface 123 and the second acting surface 124 function as first acting portion and second acting portion, respectively.

As shown in FIGS. 21A through 21C, the first and second acting surfaces 123, 124 are positioned partly in the gap 116 defined between the cover 111 and the thin plate portion 115 when these acting surfaces are oriented vertically downward (second position, and third position of the surfaces 123, 124, respectively). Further, the first and second acting surfaces 123, 124 are positioned above the lower edge of the cover 111 when these acting surfaces are oriented horizontally (first position and fourth position of the surfaces 123, 124, respectively).

Immediately after the toner boxes 11 are accommodated in the drawer unit 3 while the drawer unit 3 is at the pull-out position, each first acting surface 123 is positioned at the second position where each first acting surface 123 is oriented vertically downward as shown in FIG. 21A, and the shutter drive member 44 positioned above the partition wall 42 is at the confronting position confronting the openings 43 of the partition wall 42.

Then, when the drawer unit 3 is moved from the pull-out position toward the accommodated position, the abutment member 117 approaches the gap 116 between the cover 111 and the thin plate portion 115, and the abutment member 117 is entered into the gap 116 from a rear end thereof, and the abutment member 117 passes through the gap 116 in accordance with the further movement of the drawer unit 3. During this movement, the abutment member 117 is successively brought into abutment with the first acting surfaces 123 so that the operation members 121 are angularly rotated so as to move the first acting surfaces 123 to the first position frontward of the second position by the pushing force of the abutment member 117.

In accordance with the movement of the first acting surface 123, the shutter drive member 44 is moved from the confronting position confronting the openings 43 to the offset position out of confrontation with the openings 43 as shown in FIG. 16A. Thus, the shutter 73 is moved frontward along with the shutter drive member 44 from the closed position to the open position. In this case, the second acting surface 124 is moved from the fourth position extending rearward to the third position extending vertically downward.

When the toner box 11 is to be removed from the drawer unit 3, the drawer unit 3 is drawn out from the accommodated position toward the pull-out position after opening the front cover 4. In this movement, the abutment member 117 is moved through the gap 116 from its front end portion to the rear end portion. During this movement, the abutment member 117 is successively brought into abutment with the second acting surfaces 124, so that each operation member 121 is angularly rotated so that the second acting surface 124 is moved from the third position to the fourth position by pushing force from the abutment member 117. Consequently, the shutter drive member 44 is moved rearward from the offset position (out of confrontation with the openings 43) to the confronting position confronting the openings 43 as shown in FIG. 16B. Thus, the shutters 73 are moved rearward along with the shutter drive members 44 from their open position to the closed position.

While the invention has been described in detail with reference to the embodiment and modification thereof, it would be apparent to those skilled in the art that various changes and modifications may be made therein without departing from the spirit of the invention.

What is claimed is:

1. An image forming device comprising:

a main casing defining an accommodation space;

a holder unit configured to be movable in a moving direction between an accommodated position in which the holder unit is accommodated in the accommodation space and a pull-out position in which at least part of the holder unit is outside the accommodation space;

a plurality of image bearing members that are held by the holder unit and that are juxtaposedly arrayed in the moving direction with intervals between neighboring image bearing members;

a plurality of developing units that are held by the holder unit in one to one correspondence with the plurality of image bearing members;

a plurality of toner boxes that are detachably attachable to the holder unit in one to one correspondence with the plurality of developing units, each toner box being detachably attachable to the holder unit at the pull-out position, each toner box including: a toner container accommodating therein toner and formed with an opening through which toner in the toner container is to be supplied to the corresponding developing unit; and a shutter movable between an open position for opening the opening and a closed position for closing the opening;

a first acting portion that is provided at the holder unit and that is configured to be movable between a first position providing the open position of the shutter and a second position providing the closed position of the shutter;

a second acting portion that is provided at the holder unit and that is configured to be movable between a third position providing the open position of the shutter and a fourth position providing the closed position of the shutter; and, an abutment member provided in the main casing and configured to allow the first acting portion to abut against the abutment member when the holder unit is on its way to the accommodated position from the pull-out position while the first acting portion is at the second position, to thereby move the first acting portion to the first position, and to allow the second acting portion to abut against the abutment member when the holder unit is on its way to the pull-out position from the accommodated position while the second acting portion is at the third position, to thereby move the second acting portion to the fourth position.

2. The image forming device as claimed in claim 1, wherein the first acting portion and the second acting portion are arranged with each other in the moving direction of the holder unit.

3. The image forming device as claimed in claim 1, further comprising a shield member configured to cover the first acting portion in its entirety when the first acting portion is at the first position and to cover the second acting portion in its entirety when the second acting portion is at the fourth position.

4. The image forming device as claimed in claim 1, wherein the holder unit is formed with a groove permitting the abutment member to pass therethrough when the holder unit is moved between the accommodated position and the pull-out position.

5. The image forming device as claimed in claim 1, wherein the second acting portion is moved from the fourth position to the third position in interlocking relation to the movement of the first acting portion from the second position to the first position, and the first acting portion is moved from the first position to the second position in interlocking relation to the movement of the second acting portion from the third position to the fourth position.

6. The image forming device as claimed in claim 5, wherein the first acting portion is integral with the second acting portion.

7. The image forming device as claimed in claim 1, wherein the holder unit defines a predetermined reference plane extending in a direction parallel to the moving direction of the holder unit; and, wherein the first acting portion and the second acting portion are positioned above the predetermined reference plane when the first acting portion and the second acting portion are at the first position and the fourth position, respectively, and at least portions of the first acting portion and the second acting portion are positioned below the predetermined reference plane when the first acting portion and the second acting portion are at the second position and the third position, respectively.

8. The image forming device as claimed in claim 7, wherein the holder unit is provided with a shield member configured to cover the first acting portion in its entirety when the first acting portion is at the first position and to cover the second acting portion in its entirety when the second acting portion is at the fourth position, wherein the holder unit is further provided with a protruding portion, and wherein the shield member and the protruding portion define, therebetween, a groove permitting the abutment member to pass therethrough when the holder unit is moved between the accommodated position and the pull-out position, the groove extending in the direction parallel to the moving direction of the holder unit, the shield member having a lower edge that defines the groove and that functions as the predetermined reference plane.

9. The image forming device as claimed in claim 8, wherein the lower edge of the shield member and the protruding portion are spaced away from each other by a distance capable of guiding movement of the abutment member.

10. The image forming device as claimed in claim 1, wherein the holder unit is provided with a pair of side plates each extending in the moving direction and defining a space therebetween for accommodating therein the toner box, the first acting portion and the second acting portion being provided at on one of the side plates.

11. The image forming device as claimed in claim 1, wherein the first acting portion and the second acting portion are provided for each of the plurality of toner boxes.

12. The image forming device as claimed in claim 1, wherein the first acting portion and the second acting portion provide a first acting surface and a second acting surface, respectively, the first acting surface extending perpendicular to the second acting surface.

13. The image forming device as claimed in claim 1, wherein the holder unit is provided with a shutter drive member that is connected to both of the first acting portion and the second acting portion and that is configured so as to be connectable with the shutter to move the shutter between the open position and the closed position.

* * * * *